United States Patent [19]

Carroll et al.

[11] Patent Number: 4,574,883

[45] Date of Patent: Mar. 11, 1986

[54] WELL TOOL STOPPING DEVICES, SYSTEMS AND METHODS

[75] Inventors: Albert W. Carroll; Joseph L. Pearce, both of Dallas, Tex.

[73] Assignee: Otis Engineering Corporation, Dallas, Tex.

[21] Appl. No.: 444,496

[22] Filed: Nov. 24, 1982

[51] Int. Cl.[4] ..... E21B 23/04; E21B 23/08

[52] U.S. Cl. ..... 166/255; 166/72; 166/117.5; 166/156; 166/237; 166/242; 166/383

[58] Field of Search ..... 166/255, 382–384, 166/153–156, 113, 125, 117.5, 117.6, 237, 242, 72; 175/4.51, 79; 285/304, 306, 315, 317, 39, DIG. 21; 294/86 R, 15, 13

[56] References Cited

U.S. PATENT DOCUMENTS

| | | | |
|---|---|---|---|
| 2,212,594 | 8/1940 | Evans | 166/117.6 |
| 2,673,614 | 3/1954 | Miller | 166/214 |
| 3,510,153 | 5/1970 | Newton | 285/315 X |
| 3,540,537 | 11/1970 | Brown | 175/251 |
| 3,696,868 | 10/1972 | Taylor | 166/322 X |
| 3,744,564 | 7/1973 | Mott | 166/72 X |
| 3,827,490 | 8/1974 | Moore, Jr. et al. | 166/117.5 |
| 3,856,083 | 12/1974 | Mott | 166/322 |
| 3,858,650 | 1/1975 | Mott | 166/72 X |
| 3,937,279 | 2/1976 | Raulins | 166/214 |
| 4,043,392 | 8/1977 | Gazda | 166/154 X |
| 4,056,145 | 11/1977 | Jett et al. | 285/306 X |
| 4,114,694 | 9/1978 | Dinning | 166/318 |
| 4,126,179 | 11/1978 | Long | 166/156 X |
| 4,143,712 | 3/1979 | James et al. | 166/72 |
| 4,190,107 | 2/1980 | Oden et al. | 285/306 X |
| 4,406,325 | 9/1983 | Bowyer | 166/214 |

*Primary Examiner*—James A. Leppink
*Assistant Examiner*—Hoang C. Dang
*Attorney, Agent, or Firm*—Albert W. Carroll

[57] ABSTRACT

A tool stopping device for use in well flow conductors for stopping well tools moving therethrough, these devices being located at desired checkpoints, their arrival thereat indicating the progress of the tools in the flow conductor, each device having lugs movable between an inner, tool stopping position and an outer position in which they do not obstruct the bore of the device, each device also having a mechanism remotely actuable from the surface for moving the lugs between their outer and inner positions, whereby tools may be stopped by the lugs when in their inner position, after which the lugs may be moved to their outer position to free the tools for movement beyond the device. In some forms of the devices, the lugs may stop tools in position where they are to be locked in place. In another form, the tools are stopped by a shoulder in the device and the lugs are then contracted to anchor the tool in engagement with that shoulder. In further forms, the device has a lug which may block the slot in an orienting sleeve incorporated therein for stopping a perforating gun, kickover tool, or the like, after being oriented, the lug being remotely retractable to a position wherein it does not block the slot, thus freeing the tool for unhindered movement therebeyond. Systems and methods relating to such devices are also disclosed.

40 Claims, 31 Drawing Figures

WELL TOOL STOPPING DEVICES, SYSTEMS AND METHODS

This application is related to co-pending application entitled "RELEASABLE WELL TOOL STOPPING DEVICES AND SYSTEMS" filed concurrently herewith and given Ser. No. 06/444,188, now U.S. Pat. No. 4,465,132.

BACKGROUND OF THE INVENTION

1. Field of the Invention

This invention relates to well tools and more particularly to devices for releasably stopping movement of well tools at known locations in well flow conductors.

2. Description of the Prior Art

In performing operations in wells through use of well tools run thereinto on tool strings utilizing wireline or pumpdown equipment and techniques, it is often desirable to know the location of such tools in the well. When using wireline tools, the wireline passes through a meter which indicates the general location of the tools at all times with respect to a zero-point usually at the earth's surface. Such metering of the wireline is satisfactory for most downhole operations but oftentimes not accurate enough. Inaccuracies in measuring wireline arise because of factors such as: a worn metering wheel, the metering wheel not designed for the wireline in use, the tension on the wireline as it is lowered into the well is not the same as when it is withdrawn, or slipping of the meter wheel relative to the wireline, or malfunction of the metering device.

In pumpdown operations, the string of tools, also called a tool train, includes piston units, thus adapting the tool train for being moved into and out of the well by fluid pressure as fluids, such as oil or water, or the like, are circulated through the well. It is highly desirable to know the location of the tool train in the well, and in the past such knowledge was for the most part obtained from measuring the volume of liquids pumped into the well. The measurements thus obtained were only approximate, and the true location of the tools was often questionable. Errors occurred because of several factors. For one thing, some fluid bypasses the tool train. Pumpdown piston units have a built-in bypass passage. Also, some fluid passes around the pistons as they pass by enlarged bores, as in pipe couplings, valves, landing nipples, etc. Further, the flow meter may not measure the pumped liquid accurately. Then too, the volume of the flow conduit through which the tool train is moving may not be known precisely.

Because of the errors mentioned above which causes some guesswork in attempts to determine the location of a tool string in a well, means other than measuring wireline or pumped fluids must be used, for instance, reference points (checkpoints) fixed in the well flow conductor.

The following prior art patents are believed pertinent to this invention.

3,696,868, 3,827,490, 3,937,279

U.S. Pat. No. 3,937,279 issued to George M. Raulins on Feb. 10, 1976 and was assigned to Otis Engineering Corporation, Dallas, Tex., employer of the inventors of the instant invention. Pat. No. 3,937,279 illustrates and describes a device for use as a part of a well flow conduit. It comprises a sliding sleeve having collet fingers with bosses thereon and slidably disposed in a housing having a cam shoulder therein. In one position of the sleeve, the device does not restrict the bore of the flow conductor, but when the sleeve is shifted to its other position, the collet fingers are cammed inwardly and held in a position wherein their bosses definitely restrict the bore such that the device will stop well tools of ordinary size and may even catch tools of ordinary size should they be dropped inadvertently from above. Thus, this device provides a "no-go" shoulder in the well when the sleeve is in one position but is nonrestricting when the sleeve is in the other position. To shift the device between its restricting and nonrestricting positions, a shifting tool must be run into the well on a string of tools to engage and shift the sleeve. A special trip of the tools must be made for each shifting of the sleeve. When a string of tools has been stopped by the device of Pat. No. 3,937,279, the device cannot at that time be shifted to nonrestricting position to let the tool string move therepast since shifting of the sleeve requires a separate trip into the well with a shifting tool as explained earlier.

U.S. Pat. No. 3,696,868 issued to Donald F. Taylor, Jr. on Oct. 10, 1972 and shows that it is old to operate a downhole well tool remotely from the surface by pressurized control fluid, the control fluid being supplied from a surface control unit and being conducted to the well tool downhole via a fluid conduit and admitted into the well tool through a lateral port to act upon the pressure responsive area of a longitudinally slidable annular piston.

U.S. Pat. No. 3,827,490 issued to Howard H. Moore, Jr., et al. on Aug. 6, 1974 and teaches use of side Pocket mandrels having an orienting sleeve therein, this orienting sleeve having an orienting slot and a guide surface below the slot and directed upwardly and inwardly towards the bottom of the slot, and a shoulder positioned at the top of and blocking the slot. This shoulder is for stopping a kickover tool but is fixed and is not retractable.

The present invention overcomes such difficulty by providing tool stopping devices which are remotely actuated from the earth's surface by fluid pressure and can be shifted at will. Well systems in which a plurality of such devices installed at known locations or checkpoints are used in a well having one or a plurality of well flow conduits, including well tubing, and even flow lines, are provided, and such devices may be actuated simultaneously or otherwise to stop well tools at such known locations and then let them move therepast to be stopped at the next location so that the exact location of the tool string can be known at least when they reach these successive checkpoints. Thus, the invention also provides methods of determining the arrival of well tools at known checkpoints in wells, thus indicating their true location.

Thus, the present invention is an improvement over the invention of George M. Raulins which is disclosed in U.S. Pat. No. 3,937,279 discussed hereinabove.

SUMMARY OF THE INVENTION

The present invention is directed to well devices for use in well flow conductors for selectively and releasably stopping well tools moving through such conductors for the purpose of limiting their movement relative to the conductors or to determine the location of such well tools along the conductors. Such well tools may be moved through the flow conductors of wells through use of conventional wireline equipment, in which case the well tools are lowered into and retrieved from such wells on a wireline, or through use of pumpdown equipment and techniques, in which case the well tools are forced into and out of wells by fluid pressure as liquids are circulated through the wells by pumping equipment. The present invention is also directed to systems using such tool stopping devices, in which systems the tools may be stopped at a plurality of checkpoints of known location in the system, not only as the tools are moved into the well but also on the return trip back to the point of origination. Such systems may involve devices in a plurality of tubing strings and the flow lines connected thereto, and each device is actuatable from the earth's surface. The devices may be actuated individually or any number of them or all of them in unison, depending upon the plumbing of the conduit means provided for conducting actuating or control fluid to the devices in the system. Further, the present invention is directed to methods for monitoring the location of well tools as they move through well flow conductors by causing them to give indication at the surface as they reach successive checkpoints at known locations in the well flow conductor while such tools are moved into the wells and, if desired, on the return trip also. In addition, such devices may be used in conjunction with other tool stopping means such as no-go shoulders, or the like, in which case such shoulder will stop the tools, and then the tool stopping device of this invention is actuated to limit movement of the well tool in the opposite direction, thus locking such tool in place in the well flow conductor by confining a portion thereof between such stop shoulder and the tool stopping lugs of the tool stopping device.

It is therefore one object of this invention to provide a tool stopping device for stopping well tools at known locations in well flow conduits.

Another object of this invention is to provide a device of the character described which is actuable remotely by fluid pressure transmitted thereto from the earth's surface.

Another object of this invention is to provide such tool stopping devices which after having stopped well tools are releasable to allow such tools to pass through and beyond such devices.

Another object is to provide such tool stopping devices which are capable of stopping well tools both moving into wells and on the return trip to the originating point.

Another object is to provide tool stopping devices of the character described which include a stop shoulder for stopping well tools and also include tool stopping lug means which are actuable to inner positions to engage a well tool, after it has been stopped by the stop shoulder, to prohibit movement of the well tool in the opposite direction.

Another object is to provide such tool stopping devices which are normally in the release mode, in which mode well tools freely pass therethrough and are actuable to tool stopping mode by application of fluid pressure thereto for stopping well tools.

Similarly, it is an object to provide similar tool stopping devices which are normally in the tool stopping mode for stopping well tools but are actuable to release mode for allowing such well tools to move therepast and beyond.

It is a further object to provide a well tool in the form of a side pocket mandrel having an orienting sleeve therein, the orienting sleeve having an orienting slot passing therethrough, and there being a lug which in its inner position projects into and blocks the orienting slot, but is remotely actuable to retracted position where it does not project into the slot.

A further object of this invention is to provide a well system including a well bore, a string of tubing in the well bore, at least one tool stopping device in the tubing string, and means for transmitting fluid pressure to the one or more tool stopping devices from the earth's surface for remote actuation of such devices for stopping well tools moving through the tubing string.

Another object is to provide a well system including a well bore, a plurality of tubing strings in the well bore, one or more tool stopping devices in one or more of the tubing strings for stopping well tools moving through the tubing strings, and control conduit means for transmitting fluid pressure from the earth's surface to each of the tool stopping devices for remote actuation thereof.

Another object is to provide well systems of the character described wherein control fluid conduit means is fluidly connected to each of the tool stopping devices in the system and the other of its ends connectable to a source of fluid pressure at the earth's surface for actuation of such devices.

Another object is to provide well systems of the character described in which control fluid pressure is transmitted to each of the tool stopping devices from the earth's surface through the annulus between the well bore wall and the exterior surface of the well tubing.

Another object is to provide well systems of the character described in which a small diameter control fluid conduit is disposed in the annulus exterior of the well tubing and has its lower end connected to at least one of the tool stopping devices in the well tubing and its upper end connectable to a source of fluid pressure on the earth's surface.

Another object is to provide well systems of the character set forth in which a single control fluid conduit is connected to all of the tool stopping devices in a single tubing string and has its upper end connectable to a source of control fluid pressure at the surface so that all tool stopping devices in such tubing string will actuate in unison.

Another object is to provide a well system such as that described in which a plurality of tool stopping devices is provided in each of a plurality of tubing strings, and all such tool stopping devices are supplied control fluid pressure from the earth's surface via a single control fluid conduit and all such devices actuate in unison.

Another object is to provide well systems of the character described in which a circulation path is provided and in which well tools can be moved into and out of at least one tubing string in the well by pressure of fluid forced through the well's circulation path as in well-known pumpdown or TFL operations, the at least one tubing string having therein at least one remotely actuated tool stopping device.

Another object is to provide a method of stopping well tools at a known location in a well by remotely actuating a tool stopping device by applying actuating fluid pressure thereto from the earth's surface.

Another object is to provide a method of the character described in which the tool stopping device after having stopped the well tool is actuated to the release mode to permit the well tool to pass through the tool stopping device and beyond.

Another object of this invention is to provide such a method in which well tools are stopped at a series of successive tool stopping devices at known locations in a well by actuating such devices to tool stopping mode to stop the well tool, actuating the devices to permit the well tool to pass therethrough, again actuation the devices to again stop the well tool and continuing thus until such well tool has reached its destination in the well.

Another object of the invention is to provide such a method in which such tool stopping devices are also alternately actuated to tool stopping and tool releasing positions to cause the well tool to be stopped at successive tool stopping devices on the return trip from the well.

Other objects and advantages will become apparent from reading the description which follows and from studying the accompanying drawing, wherein:

DESCRIPTION OF THE PREFERRED EMBODIMENTS

Figure 1:
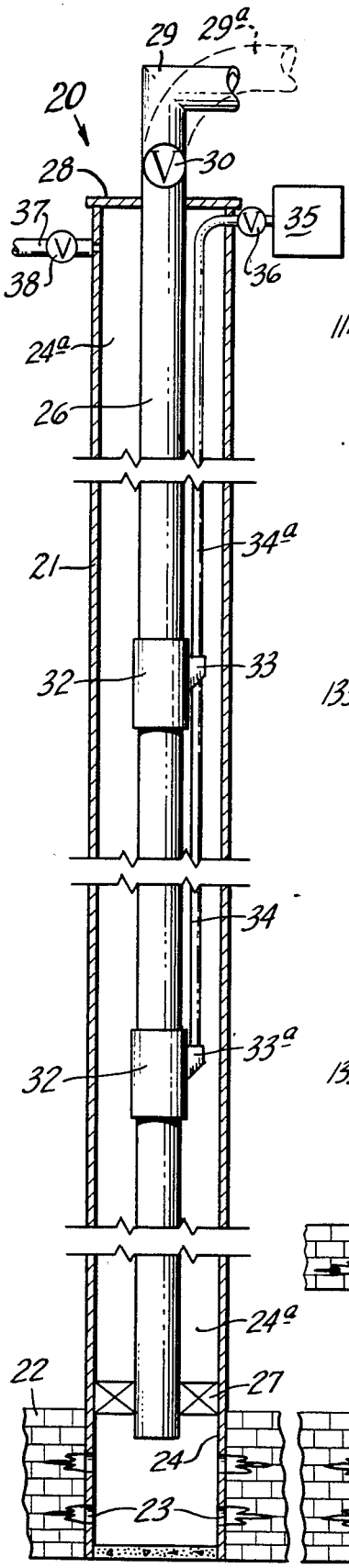
FIG. 1 is a diagrammatical view of a well installation showing a well in which the well tubing contains a plurality of tool stopping devices of this invention which are remotely actuable from the earth's surface.

Referring now to FIG. 1, it will be seen that a well installation or system is illustrated diagrammatically and is indicated generally by the reference numeral 20. Its well casing 21 penetrates an earth formation such as petroleum bearing formation 22 and is perforated as at 23 to provide entrance passages so that petroleum products from the formation 22 may readily enter the bore 24 of casing 21.

A well flow conduit such as tubing string 26 is disposed in the well casing 21, and a packer 27 seals between the exterior of the tubing and the inner wall of the casing above the formation. Products entering the casing 21 through the perforation 23 are directed into the lower end of the tubing 26 since the packer 27 isolates the tubing-casing annulus 24*a* above the packer from that below.

A wellhead 28 closes the upper end of the casing around the well tubing in a conventional manner, and a flow line 29 is fluidly connected to the tubing. A valve 30 controls flow from the tubing into the flow line. This valve 30 may represent a conventional Christmas tree or other suitable surface connections so that well tools may be readily lowered into the well either by wireline or by pumpdown (through flow line-TFL) methods, both of which are well known in the industry. Of course, if pumpdown tools are to be moved into the well, the flow line should be curved as at 29*a* to avoid sharp turns or bends which such tools cannot negotiate.

The well tubing 26 contains, as a part thereof, a plurality of well tool stopping devices 32 which embody the present invention. Each device 32 contains tool stopping lugs which are radially movable between inner tool stopping positions and outer tool passing positions, and means for moving the lugs between those two positions. The means for moving the lugs includes pressure responsive means, and a lateral port is provided in the wall of the device to admit fluid pressure thereinto to act on the pressure responsive means to actuate the lugs to one of their two positions. Biasing means such as a coil spring stores energy for moving the lugs to their other position when actuating pressure is released. Fluid pressure for actuation of the devices 32 is transmitted to the downhole devices from the surface, making the devices remotely actuable.

In the well installation 20, each device 32 is provided with a ported boss, and these are respectively indicated by reference numerals 33 and 33*a*. These two bosses are not necessarily identical. Boss 33*a* has a control conduit portion 34 attached to its upper end while boss 33 is connected not only at its lower end to the upper end of control conduit portion 34 but also has its upper end connected to the lower end of control conduit portion 34*a* extending thereabove. Boss 33 simply acts as a tee-connection to connect the upper device 32 to the control conduit. If these bosses are identical, the lower end of the lowermost one must be plugged.

The control conduit 34*a* exits the casing 21 at the surface, or below the wellhead 28, and is connected to a source of fluid pressure such as control unit 35. A valve 36 is preferably placed in the control conduit 34*a* near the casing.

Control unit 35 contains a pump connectable to a source of motive power for supplying pressurized control fluid and further includes suitable valves for control of the application and the release of control fluid pressure to the control conduit 34, 34*a* and therefore to the devices 32 for their operation.

Thus, fluid pressure for actuation of tool stopping devices 32 is transmitted to them from the source of pressure 35 through the control conduit connected to each of the devices. Because the control conduit is common to both devices 32, they both will act in unison when control fluid pressure is applied to them. Of course, separate conduits could be provided so that individual devices could be actuated separately and selectively. It is understandable that such devices could be connected as desired to provide the desired results.

It is also to be understood that the control conduit 34, 34*a* could be eliminated and the tubing-casing annulus 24*a* used as the control conduit means. In this case, the control unit 35 could be connected to the casing flow line 37 through casing wing valve 38. The tubing-casing annulus would be filled full of a suitable control fluid, such as clean light oil. Control pressure from control unit 35 would then be applied to and transmitted through the column of fluid in the annulus 24*a* to the devices 32 downhole, and would be transmitted into these devices through the open lateral ports of bosses 33 and 33*a*. It follows that if the devices would be used in this manner, the bosses 33 and 33*a* could also be eliminated. Since the control fluid conduit (in this case the annulus 24*a*) would be common to all such devices in the tubing string, they would act in unison.

It is common to complete wells so that production can be had from multiple zones simultaneously. In such wells, the casing is perforated opposite a plurality of producing formations and a plurality of tubing strings (one for each zone) is installed in the casing with well packers spaced apart so as to be located between and separate the zones from each other.

Tool stopping devices embodying the present invention can be used in multiple wells to provide a system for monitoring the location of well tools as they move through the well tubing strings on their way into or out of the well.

Figure 2:
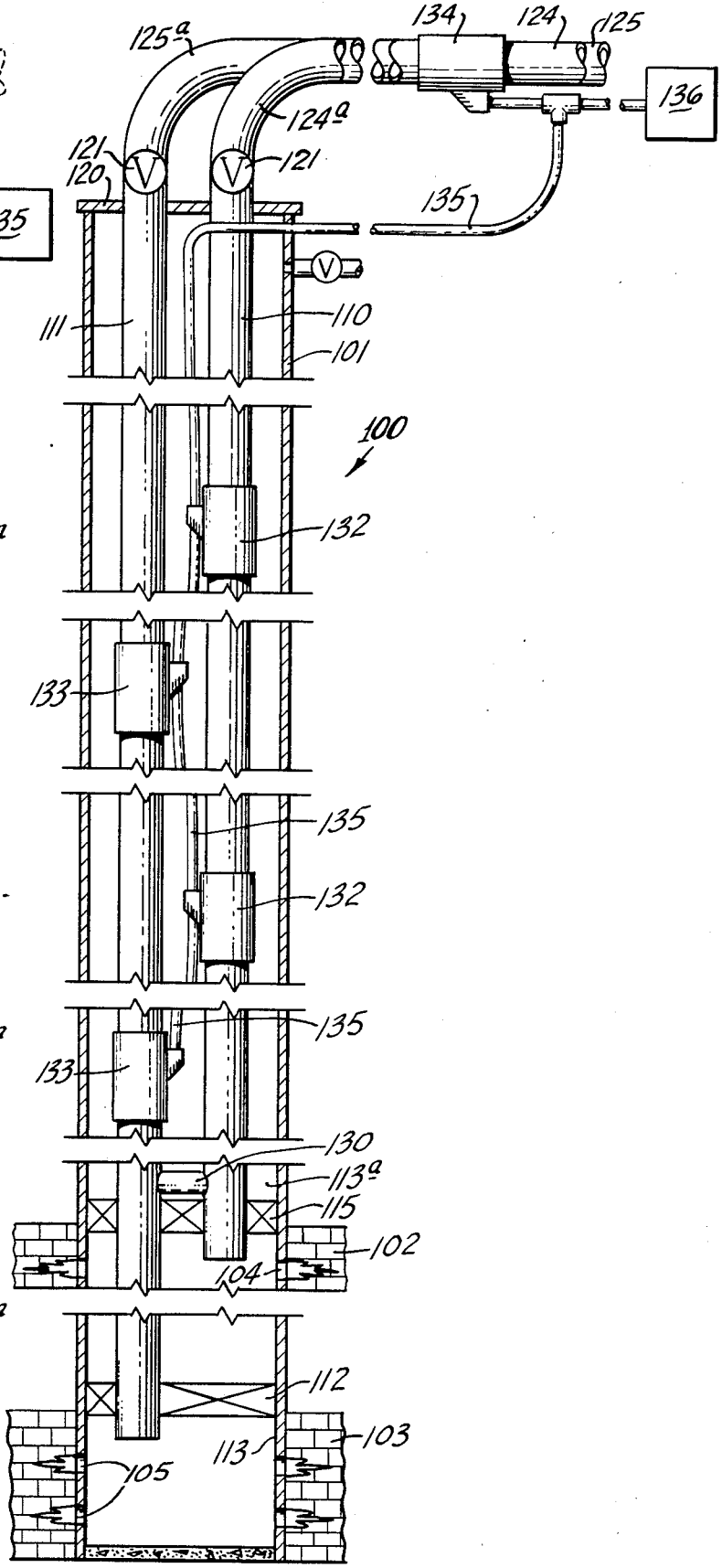
FIG. 2 is a diagrammatical view similar to FIG. 1 but showing a well installation having a plurality of tubing strings each containing a plurality of remotely actuated tool stopping devices of this invention.
Figure 5:
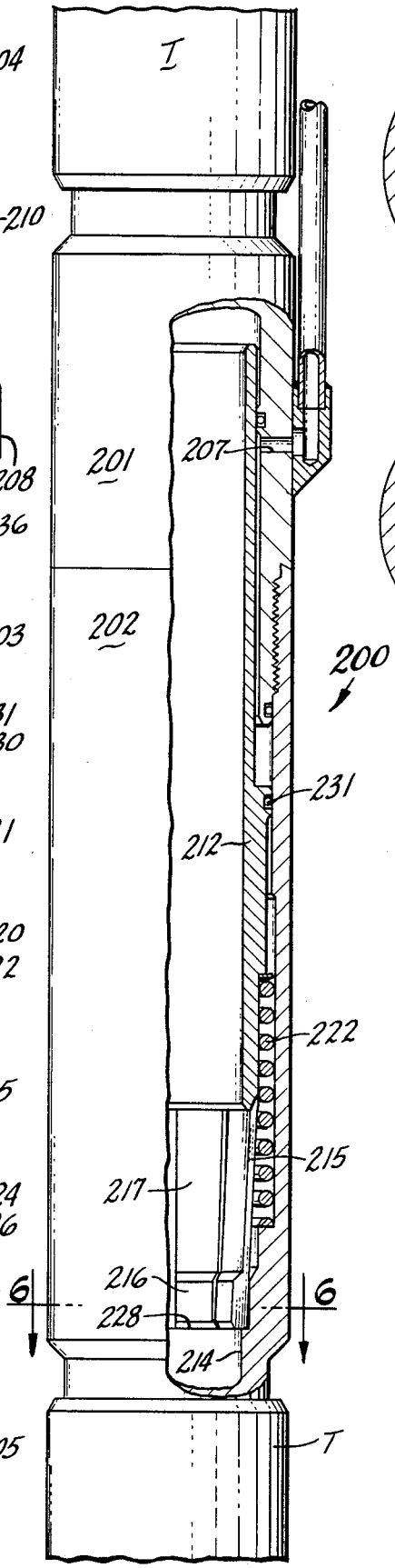
FIG. 5 is a longitudinal view similar to FIG. 3 showing the device of FIG. 3 with its tool stopping lugs in tool stopping position.
Figure 4:
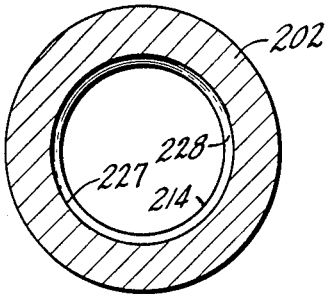
FIG. 4 is a cross-sectional view taken along line 4—4 of FIG. 3.
Figure 6:
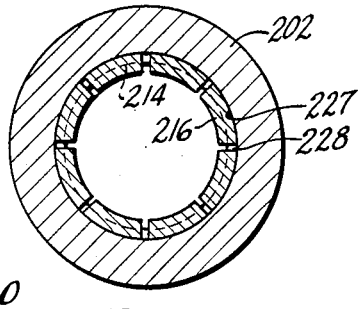
FIG. 6 is a cross-sectional view taken along line 6—6 of FIG. 5.

FIG. 2 is a diagrammatical illustration of such a multiple well system utilizing tool stopping devices constructed in accordance with this invention. The multiple well is indicated generally by the reference numeral 100. It includes a well casing 101 which extends from the surface downwardly through a plurality of production zones, in this illustration two, but could be three or more. Thus, the casing extends through upper and lower production zones 102 and 103 and is perforated opposite them as at 104 and 105, as shown. The well tubings include the short tubing string 110 and the long tubing string 111. A single well packer 112 seals between the long tubing string 111 and the casing bore 113 at a location between zones 102 and 103 while a dual packer 115 seals the casing bore around both tubing strings just above the upper zone 102. Thus, single packer 112 separates the two zones while dual packer 115 separates the upper zone 102 from the annulus 113*a* above the dual packer.

The upper end of the casing is closed about the dual tubing strings 110, 111 by a wellhead 120, and a valve 121 is placed in each tubing string immediately thereabove. Of course these valves may represent a subsea wellhead, or a subsea Christmas tree, or a conventional dual Christmas tree. If a conventional tree, it would provide vertical access for lowering well tools into the tubing strings via wireline. In the illustration of FIG. 2, tubing strings 110, 111 are connected to flow lines 124 and 125, respectively, to adapt the well for running tools thereinto via pumpdown methods. For this reason, the flow lines contain no abrupt turns, but all turns are made with a gentle bend as at 124*a* and 125*a*. (The industry standard for such bends thus far has been a radius of 60 inches minimum.) Then, in order to move the tools into and out of the well by circulation of fluids therethrough, a cross-flow connection 130 fluidly communicates the two tubing strings above the dual packer and below the lowermost tool stopping device to provide a circulation flow path in the well.

In FIG. 2, the short tubing string 110 is provided with a plurality of tool stopping devices downhole, and the devices are indicated by reference numerals 132. The long tubing string 111 is likewise provided with a plurality of such devices, and they are indicated by the reference numerals 133. The flow line 124 is connected to short tubing string 110 and is shown to be provided with a single tool stopping device 134 although it could be provided with several. Also, although no such device is shown in flow line 125 it could, as well, contain one or several, if desired.

As is shown in FIG. 2, a control fluid conduit 135 is connected to the lateral port of each of the devices 132, 133, and 134 in the system. A source of pressurized control fluid such as control unit 136 is connected to the upper or outer end of control line 135 and supplies pressurized control fluid to these devices 132, 133, 134 for their actuation. Of course, since control conduit 135 is common to all of the tool stopping devices in the system of FIG. 2, they will all be actuated simultaneously. However, these devices could be connected to a pressure source through separate control fluid conduits for operation individually and selectively, as desired.

Tool stopping devices such as device 32, 133, or 134 can be used in wells such as wells 20 and 100, and even in flow lines such as flow line 124 to provide the desired number of checkpoints therein for monitoring the location of well tools as they are moved therethrough in a manner later to be more fully explained.

Referring now to FIGS. 3–6, it will be seen that the tool stopping device here illustrated is represented generally by the numeral 200. This device includes upper and lower housing members 201 and 202 which are threaded together as at 203 and there are means at the extreme ends of the device as at 204 and 205 for connection to a tubing string T to become a part thereof. The upper housing portion 201 has a lateral port 207 intermediate its ends, and if desired a boss 208 may be prepared as shown and welded about the port 207 to adapt the device for attachment to a control line 210 as shown whereby control fluid pressure may be conducted thereto from the surface for actuation of the device in a manner to be described.

A sleeve 212 is disposed within the housing 201, 202 with its bore 213 in alignment with the bore 214 of the housing. The bore 214 of the upper and lower housing sections may be the same or approximately the same as the diameter of the bore 213 of the sleeve, but in any case the bores 213 and 214 should preferably be at least as large as the drift diameter of the tubing T to which the device is attached. The sleeve 212 has a plurality of collet fingers 215 depending from its lower end, and these fingers are each provided with an internal lug or boss 216. These bosses are provided by a recess 217 formed in the sleeve while the sleeve is still in its full cylindrical form, and this recess not only provides the internal bosses 216 but also makes the collet fingers thin and flexible after they are cut apart by mill slots 215*a*. The fingers are not inherently sprung inwardly nor outwardly, but the outer surface of the finger is coextensive with the outer surface of the lower portion of the sleeve as at 220. The sleeve is enlarged in outer diameter as at 221 to provide a downwardly facing shoulder 221*a* against which the upper end of a coil spring 222 bears to bias the sleeve 212 upwardly in the housing, the lower end of the spring being supported on upwardly facing internal annular shoulder 224 of the lower housing 202 as shown.

The sleeve 212 is shown in its uppermost position in which position the lower ends of the collet fingers are disposed in intermediate bore 226 of the lower housing member. The sleeve 212 is movable to a lower position, shown in FIG. 5, wherein the lower ends of the collet fingers may be in contact with the abrupt upwardly facing shoulder 228 of the lower housing and confined by bore 227. In moving from the upper position to the lower position, the collet fingers are cammed inwardly by cam surface 229 to their inner positions shown in FIG. 6 wherein the internal bosses 216 project into and restrict the bore 214 of the device to such extent that well tools which might otherwise pass through the device will be stopped by engagement with the internal bosses 216 of the collet sleeve 212.

The collet sleeve 212 is moved to its lower position by fluid pressure transmitted into the device through the control line 210, boss 208, and lateral port 207. In order to cause such movement of the sleeve to take place, the sleeve is provided with a piston 230 having a resilient external seal ring 231 carried in a suitable annular recess, and the upper reduced end portion 232 of the sleeve 212 is telescopingly received in the enlarged lower bore portion 214*a* of the upper housing section 201, and a resilient internal seal ring 234 seals between the upper housing and the sleeve. The seal ring 234 is located in an internal recess formed in the upper housing section just above the lateral port 207. Below the seal ring 234 the upper housing section 201 has its central bore 214 slightly enlarged as at 236 so that control fluid entering the lateral port 207 may pass freely downwardly between the inner wall of the upper housing and the outer wall of the sleeve to the upper side of the piston 230. The piston provides a pressure responsive area on the sleeve which is defined by the difference between the areas sealed by the seal rings 231 and 234. Thus when pressure is applied to the piston, it acts on this pressure responsive area, and when such pressure is sufficient to overcome the upward force resulting from the bias of spring 222, the collet sleeve 212 will move downwardly. The collet sleeve will remain in its lower position as long as the fluid holding the piston down is not allowed to bleed off.

When the control pressure is allowed to bleed from above the piston, the spring 222 will decompress and cause the collet sleeve to return to its uppermost position in which position the internal bosses 216 do not restrict the bore but leave the bore full opening through the device so that tools may pass readily therethrough.

Figure 3:
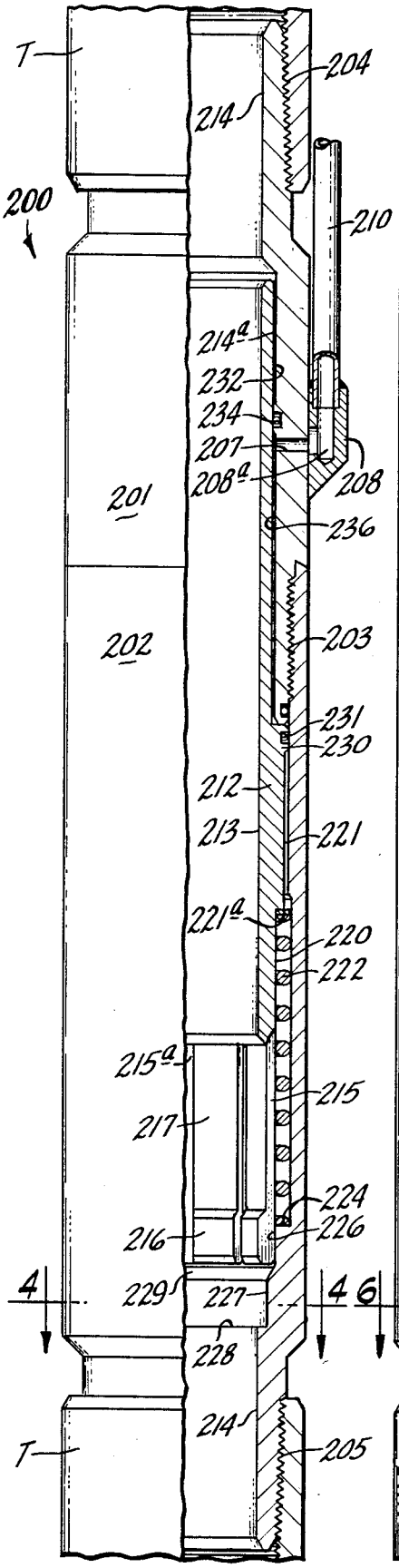
FIG. 3 is a longitudinal view, partly in section and partly in elevation of a tool stopping device constructed in accordance with this invention and showing the device in tool passing condition.
Figure 3A:
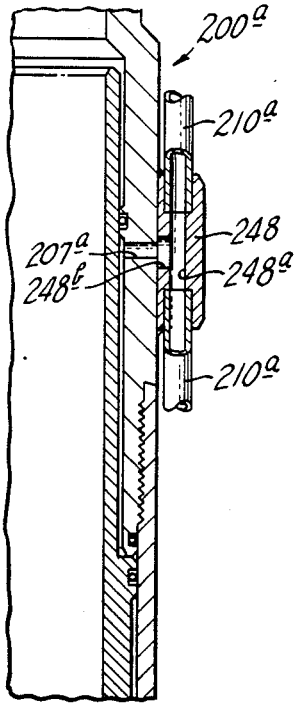
FIG. 3A is a fragmentary longitudinal sectional view showing an alternate connection between the device of this invention and the control fluid conduit.

The device of FIGS. 3–6 is shown provided with a boss welded to the outside of the upper housing member 201 and covering lateral port 207. This boss is provided with a passage 208*a* communicating with the lateral port and opening upwardly to receive a control line which may be attached by suitable means such as a thread or by welding. If it is desired to use a device such as device 200 below another device such as device 200*a*, the upper device should be provided with a modified form of boss which is indicated by numeral 248 in FIG. 3A. In this case, the boss 248 has a T-shaped passage 248*a* and constitutes a Tee-connection for connecting tool stopping devices to the control line 210*a* intermediate its ends with its lateral port 207*a* in communication with the lateral opening 248*b* of the boss.

The device 200, or the device 200*a*, either one, can be used in a well system like that shown in FIG. 1 or 2 for the purpose of stopping tools as they move into the well so that their location can be known. In such case, the tool stopping devices would be placed in the tubing string or strings of the well at known locations, and these locations would be entered in the well records. When tools were later lowered into the well either by wireline or pumpdown methods, the tool stopping device could be actuated to tool stopping condition wherein the lugs on the lower ends of the collet fingers would be held in their inner position. Thus, when the tools arrived at the first checkpoint, that is the uppermost tool stopping device, the tools would engage the lugs and stop. The operator would know that the tools were now located at the known location of checkpoint number 1 and take note thereof. Following this, the actuation pressure would be released from the device, the collet sleeve would move upwardly, the lugs would move outwardly to their outer position, and the tools could then be moved on through and beyond the device. After the tools would clear the device, actuating pressure could again be reestablished to the control line, and the next tool stopping device would be actuated so that its lugs would then be in their innermost position to stop the tools at the next checkpoint. Again, the location of the tools would be noted, the device would be opened or released, and the tools moved on therethrough and beyond, after which the tool stopping devices would be actuated again so that the tools would stop at the next checkpoint, and so on, the steps of applying control pressure to and releasing it from the devices being repeated until the tools reached their destination in the tubing string.

The device of FIGS. 3–6 is not well adapted to stopping tools on the return trip out of the well. To stop tools coming back through the device from the other direction might cause the thin collet fingers to be bent due to failure in column loading likely making it extremely difficult to get the tools through the device afterwards. Tool stopping devices which are adapted to stopping tools in either longitudinal direction will be described later.

Figure 7:
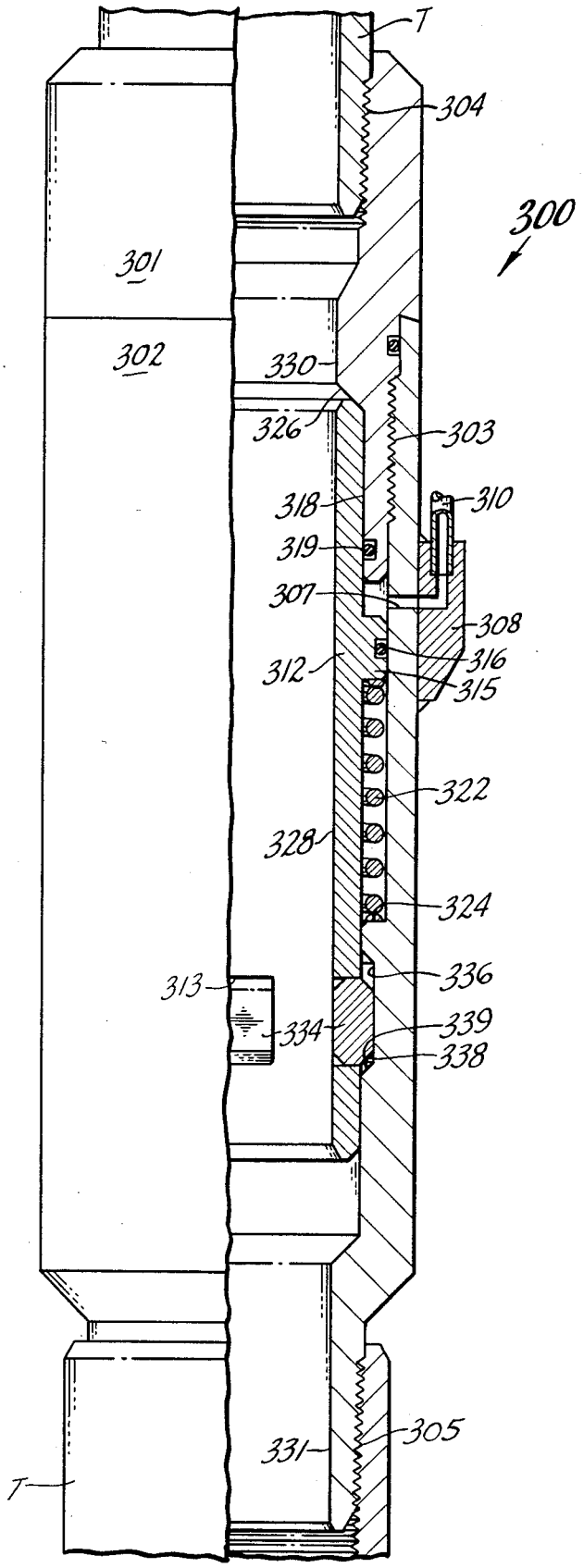
FIG. 7 is a longitudinal view, partly in section and partly in elevation, showing a device constructed in accordance with this invention and which is similar to that shown in FIGS. 3–6 but in which the tool stopping lugs are radially movable in windows rather than being carried on the ends of flexible collet fingers.

In FIG. 7 there is described a tool stopping device which is constructed in a similar manner and which operates in a manner similar to that of the device of FIGS. 3–6. This device in FIG. 7 is indicated by the numeral 300 and comprises an upper housing member 301 and a lower housing member 302 which are screwed together as at 303 to form the complete housing. This housing has means at its opposite ends 304 and 305 for connection to a tubing string T to become a part thereof. The lower housing member has a lateral port 307 in the wall thereof, and a boss 308 is welded onto the outer wall so that its passageway is in alignment with the lateral port 307 and so that its upwardly opening port may receive the lower end of a control fluid conduit such as the control fluid conduit 310. A sleeve 312 having lateral windows 313 therein is longitudinally slidably disposed within the housing, and the sleeve is provided with a piston 315 having a seal 316 engaged with the inner wall of the housing just below the lateral port 307. Above the piston the sleeve is reduced in outside diameter and telescopes into enlarged bore 318 and a resilient seal 319 seals between the housing and the sleeve above the lateral port 307.

When fluid pressure is applied through the lateral port 307 to the piston, the sleeve 312 may be moved downwardly. The fluid pressure acts on the pressure responsive surface of the piston which is defined by that area sealed by the seal ring 316 minus that area sealed by seal ring 319. Below the piston a coil spring 322 has its upper end bearing against the lower side of the piston while its lower end is supported on the abrupt upwardly facing shoulder 324 in the lower housing so that the force of the spring is exerted upwardly on the piston, tending to lift the sleeve. When the actuating pressure which has been acting on the upper side of the piston is released, the spring 322 will force the sleeve back to its uppermost position. If desired, the upper end of the sleeve 312 may engage the downwardly facing shoulder 326 at the upper end of enlarged bore portion 318 of the upper housing to limit upward movement of the sleeve.

The bore 328 of the sleeve and 330 of the upper housing section as well as the bore 331 of the lower housing section are preferably all at least as great in diameter as the drift diameter of the tubing string T.

Tool stopping lugs 334 are carried in lateral windows 313 for radial movement therein between inner and outer positions. When the sleeve 312 is in its upper position, shown in FIG. 7, the lugs may move outwardly into angular recess 336 of the lower housing so that the inner surfaces of the lugs clear the bore 328 of the sleeve so that well tools may pass readily through the tool stopping device. When control pressure is applied to the device through lateral port 307 to act on the pressure responsive area of the piston with sufficient force to overcome the force of spring 322, the sleeve 312 will move downwardly, and as it does, the cam surface 338 on the lower out corner of the lugs, will engage the upwardly facing inclined internal annular cam shoulder 339 in the lower housing and further downward movement of the sleeve relative to the housing will cause the lugs to be cammed inwardly to their inner position wherein their inner surfaces do project out into the bore through the device and restrict the same, and the lugs are able then to engage and stop well tools from passing through the device.

When control pressure is allowed to bleed from the device, the spring 322 will force the sleeve 312 back to its uppermost position, and the lugs 334 can retract as they are cammed outwardly into recess 336 by the tools as they pass on through and beyond the tool stopping device.

The tool stopping device 300 of FIG. 7 is used for the same purpose and operates in the same manner as does the device 200 previously described with respect to FIGS. 3–6. The device 300 like that of the device 200 is not well adapted to stopping tools approaching from the opposite direction to that described. It is readily seen that if tools approached the device from below with substantial force, the upward force applied to the lugs by the tools could possibly lift the sleeve 312 allowing at least a portion of the tools to pass by the lugs, and this might be damaging to the tools or possibly to the device. If it is desired to stop tools in either longitudinal direction, that is from both above and below, more suitable devices are described below.

It will be noticed that in the foregoing two embodiments, the tool stopping lugs were movable longitudinally in the device. Also, it will be noticed that the device housing was composed of two housing members screwed together and that this housing was an integral part of the tubing string.

Figure 8:
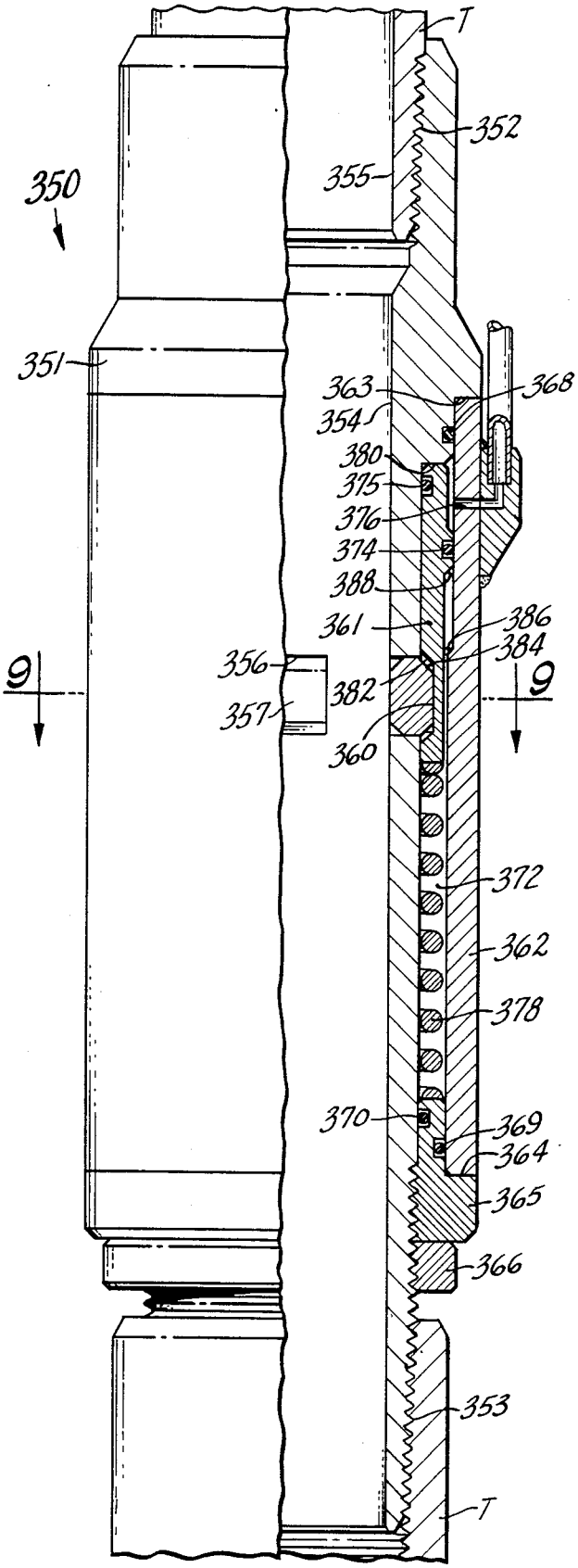
FIG. 8 is a view similar to FIG. 7 showing another form of device constructed in accordance with the present invention and having tool engaging lugs mounted in fixed windows and being capable of stopping well tools when engaged from either above or below. The device is shown in its normal tool passing condition.
Figure 9:
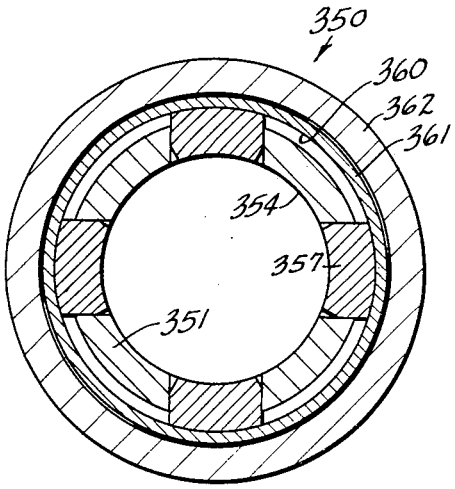
FIG. 9 is a cross-sectional view taken along line 9—9 of FIG. 8.
Figure 10:
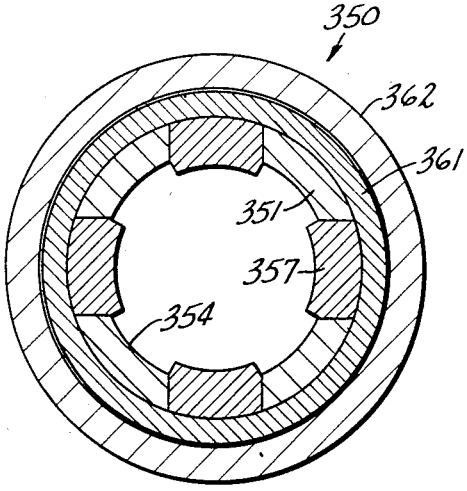
FIG. 10 is a cross-sectional view similar to FIG. 9 but showing the lugs thereof in tool engaging position.

Referring now to FIGS. 8–10, it will be seen that a third embodiment of the tool stopping device is indicated by the numeral 350. The tool stopping device 350 includes a mandrel or body 351 having means at its opposite ends as at 352 and 353 for attachment to upper and lower portions of the tubing string T respectively. The mandrel has a full opening bore 354 therethrough which is aligned with the bore 355 of the tubing string, and the bore 354 should be preferably at least as large as the drift diameter of the string of tubing to which it is connected. The body 351 is provided with a plurality of lateral windows 356 in each of which is mounted a tool stopping lug 357 which is movable radially inwardly and outwardly therein between its innermost and outermost positions. When the lugs are in their innermost positions, they project into the bore of the tubing to restrict the same, as is clearly seen in FIG. 10, and in this position they are able to engage and stop certain tools passing through the device. When the lugs are in their outermost position, as is shown in FIG. 9, the lugs clear the bore through the device so that well tools may readily pass therethrough unhindered. When the lugs are in their outermost position as shown in FIG. 8, their outer surface projects outwardly beyond the body at that point and are received in an internal annular recess 360 in the piston sleeve 361 as shown. A tubular housing 362 surrounds the mandrel as shown and is confined between a downwardly facing annular shoulder 363 formed on the mandrel near its upper end and an upwardly facing abrupt annular shoulder 364 formed on a retainer 365 screwed onto the lower portion of the mandrel as shown and secured in place by lock nut 366, also threaded on the lower portion of the mandrel. The body carries a seal ring 368 immediately below the downwardly facing shoulder 363 to seal between the mandrel and the upper portion of the housing 362 while the retainer 365 carries an external seal 369 to seal between the retainer and the lower portion of the housing 362, and it also carries an internal seal 370 which seals between the retainer and the exterior of the mandrel just above the lower threaded portion of the mandrel. Thus the mandrel is provided with means thereon for engaging the upper ends of the housing 362, and it also closes the upper and lower ends of the annular space provided between the internal surface of the housing 362 and the outer surface of the mandrel.

This annular space is indicated by the reference numeral 372. Tubular piston 361 is disposed in annular space 372 and carries an external annular seal ring 374 which seals between the piston and the inner wall of the housing 362, and it also carries an internal annular seal ring 375 which seals between the inner wall of the annular piston and the outer surface of the body, as shown. The piston 361 thus has a pressure responsive area which is defined as that area sealed by piston seal 374 minus that area sealed by the piston seal 375. It will be noted that the piston seal 374 is positioned below the lateral port 376 of the housing 362 so that pressure entering the housing to the lateral port 376 will be effective against the pressure responsive area of the piston, and when this pressure is of sufficient magnitude, it will force the tubular piston 361 downwardly in opposition to the upward force of coil spring 378 which is disposed in annular space 372 and has its upper end bearing against the lower end of the tubular piston 361 while its lower end is supported on the upper end of the retainer 365. When the piston is in the upper position shown with its upper end engaged with the downwardly facing shoulder 380 of the mandrel, the lugs 357 are engaged in the recess 360 of the tubular piston, but when the piston 361 is moved downwardly by the force of fluid pressure transmitted into the device through the lateral port 376 and acting on the piston, the downwardly facing inclined cam shoulder 382 at the upper side of the internal recess 360 of the piston will engage the upper outer beveled corner 384 of the lugs and will cam them inwardly to their innermost position, shown in FIG. 10. The outer seal 374 of the piston seals with the housing where the housing bore is slightly enlarged providing an upwardly facing shoulder as at 386. This annular shoulder 386 will be engaged by a similar downwardly facing shoulder 388 on the lower side of the piston to limit downward movement of the piston in the annular space 372. In this lower position, the piston 361 will securely maintain the tool stopping lugs in their innermost position, shown in FIG. 10.

Since the tool stopping lugs 357 are disposed in lateral windows 356 of the mandrel which has both of its ends attached to the tubing string and cannot move longitudinally, then neither can the lugs move longitudinally relative to the mandrel. These lugs, then, are capable of stopping well tools engaging them from either longitudinal direction, that is from above or from below, with equal dependability. For this reason, this device can be used to stop tools on their way into the well or on their way out of the well. This of course makes it possible to monitor the location of tools in a well system by causing the tools to stop at checkpoints of known location therein not only on their trip into the well but on their return trip out of the well also.

Figure 8A:
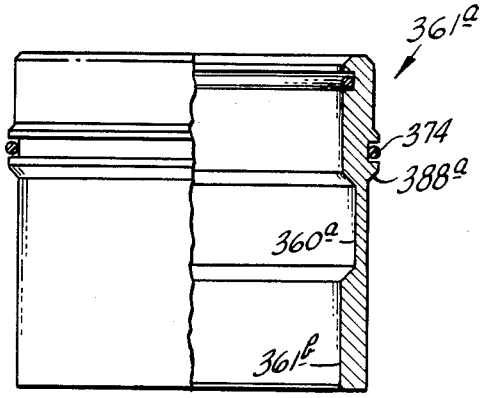
FIG. 8A is a longitudinal view, partly in section and partly in elevation, showing an alternate form of piston for the device of FIG. 8 which when substituted therein in place of the piston shown converts the device so that it will then be normally in the tool engaging condition.

It is understandable that while the tool stopping devices have thus far been of such structure that they are normally in tool passing position, that is, without control pressure applied thereto, the spring will hold the sleeve or piston of the device in such position that the tool stopping lugs will be in their outer tool passing position. Either of the tools could be constructed so that the lugs would normally be in their other position, that is, they would normally be in their innermost position, in which position they are able to stop tools from passing through the device in which case it would be necessary to apply actuating control pressure to the device in order to move the lugs to their outermost position and let tools pass by. With respect to the tool stopping device illustrated in FIGS. 8–10, it is easy to convert the device from the normally open device shown to a device in which the lugs are normally contracted. To convert this device, it needs only to be disassembled and the piston **361*a* of FIG. 8A installed in the place of the normal piston 361. The piston 361*a* has a lug recess 360*a* which is located higher in the piston, whereas the piston 361 had the lug recess near its lower end. When piston 361 is in the device and is in its uppermost position wherein its upper end is abutted with downwardly facing shoulder 380 of the body, the lug receiving recess 360*a* is positioned above the lugs, and the lugs are held confined by the bore portion 361*b* of the piston 361*a*. When the device is actuated by application of control pressure, the piston moves to its lowermost position wherein its stop shoulder 388*a* below the external seal 374 engages the upwardly facing shoulder 386 in the housing, and in this position the lug receiving recess 360*a* of piston 361*a* is in alignment with the lugs 357 which can now freely move outwardly thereinto to clear the bore 354** of the device for the passage of tools therethrough.

Thus the device 350 of FIG. 8 is readily convertable from a normally open device to a normally restricting device.

Figure 8B:
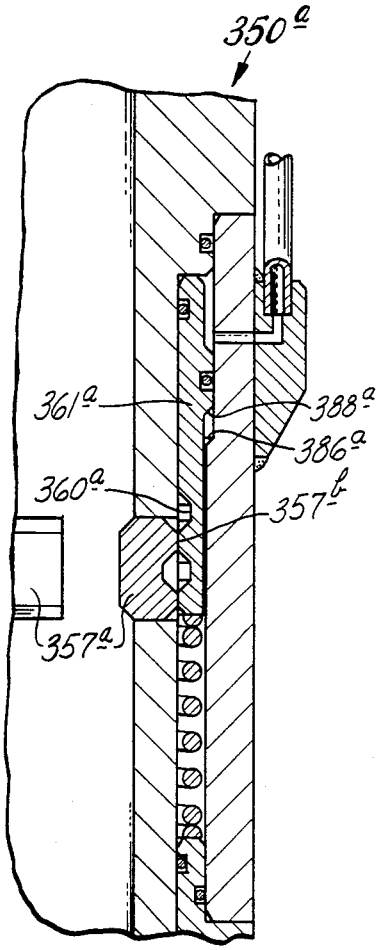
FIG. 8B is a fragmentary view of a device similar to that of FIG. 8 but in which the coengageable surfaces of the tool engaging lugs and the cam sleeve are configured with corresponding profiles which greatly reduce the stroke length required of the piston for actuation of the lugs.

A modified form of the embodiment (350) just described is shown in FIG. 8B where it is indicated generally by the numeral 350*a*. It is shown to be normally in tool stopping condition without control pressure applied thereto. Device 350*a* is structured like that of device 350 except for the modified piston 361*a* and the modified lugs 357*a* plus the fact that it is normally in tool stopping condition until control pressure is applied to it, whereas device 350 is normally in tool passing condition as shown in FIG. 8.

It will be noticed that the lugs 357*a* have their outwardly facing surface formed with a pair of outwardly extending bosses 357*b* and the piston 361*a* is formed with a pair of corresponding internal recesses 360*a* which are adapted to receive the bosses 357*b* when the piston is in its lower position wherein the external downwardly facing shoulder 388*a* thereon is engaged with corresponding internal upwardly facing shoulder 386*a*. In this position, the lugs 357*a* are free to move outwardly to allow tools to pass through the bore of the device 350*a*.

It will be noticed that this piston/lug arrangement of device 350*a* has an advantage not found in the device 350 in that the stroke of piston 361*a* is only one-third that of piston 361. Thus, its displacement is reduced to one-third and its reaction time is, accordingly, reduced to one third, other things being equal. Further, this short stroke piston arrangement is more suitable for use with very small diameter control lines which are presently finding favor in the industry. These very small diameter control lines are less crushable and are therefore easier to protect. And, since fast reaction times are not so important in tool stopping devices, they could be actuated at great depths with reasonable reaction times and with such very small diameter control lines.

Figure 11:
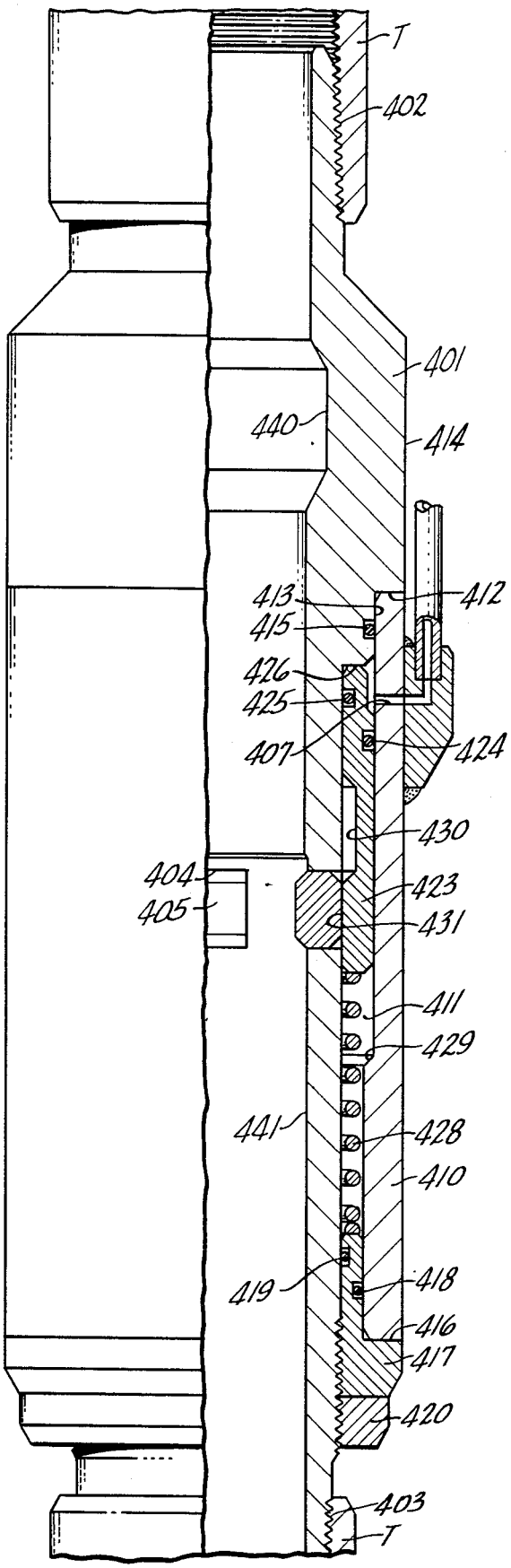
FIG. 11 is a longitudinal view, partly in section and partly in elevation, showing a device constructed in accordance with this invention and similar to the device of FIG. 10 but having a smooth bore and annular locking recess above the tool engaging lugs.

A fourth embodiment of this invention is seen in FIG. 11 and is there indicated generally by the numeral 400. This device is constructed in a manner very similar to that of the device of FIG. 8 with a few exceptions. The device 400 comprises a mandrel or body 401 having means at its opposite ends as at 402 and 403 for attachment to a tubing string T in the well-known manner and intermediate its ends the mandrel is provided with a plurality of lug receiving windows 404 in each of which is received a tool stopping lug 405 as shown. These tool stopping lugs are movable in the windows radially between inner and outer positions as before described. A housing 410 surrounds the mandrel providing an annular space 411 therebetween, and the mandrel is provided with means thereon for closing opposite ends of this annular space. Thus the upper end of the housing 410 abuts a downwardly facing shoulder 412 provided by the enlarged portion 413 of the mandrel, and a seal ring 415 seals between the upper end of the housing and the mandrel as shown. The lower end of the housing 410 is supported on an abrupt upwardly facing shoulder 416 formed on retainer 417, and this retainer carries an external annular seal 418 which seals between the retainer and the lower portion of the housing while an internal seal 419 carried on the retainer seals between the retainer and the exterior of the body. The retainer 417 is threaded on the body and secured in place by a lock nut 420. An annular piston 423 is disposed in the annular space 411 about the body and is movable longitudinally therein. The piston carries an external seal 424 which seals between the piston and the inner wall of the housing, and it also carries an internal seal 425 which seals between the piston and the exterior of the mandrel. The upper end of the piston abuts a downwardly facing shoulder 426 of the body when the piston is in its uppermost position, thus limiting upward movement of the piston in the annular space. The lower end of the piston is engaged by the upper end of a spring 428, and the spring is supported on the upper end of the retainer 417 so that the spring applies an upward bias to the piston, tending to hold the piston in its uppermost position except when the control fluid pressure conducted into the housing above the piston through the lateral port 407 is sufficient to overcome the force of the spring and move the piston 423 to its lowermost position. In the lowermost position of the piston, its lower end engages upwardly facing shoulder 429 in the housing. The piston 423 is provided with a lug receiving recess 430 which, when the piston is in its lowermost position, is aligned with the lugs so that the lugs can freely move outwardly thereinto to clear the bore through the device for the passage of tools therethrough, but when the piston is in its uppermost position (shown), the recess is above the lugs and the bore wall 431 of the piston confines the lugs in their innermost position, in which position they are able to stop tools from passing through the device.

The device shown in FIG. 11 has its lugs normally in their innermost position. It might be termed a normally closed device. It could be readily converted to a normally open device by replacing the piston 423 with a piston having its lug receiving recess formed lower therein so that the recess would be aligned with the lugs when the piston is in its uppermost posiition. This of course is as before explained. The device 400 of FIG. 11 is different from the device 350 of FIG. 8 previously described in that the device 400 is provided with a lock recess 440 which in the drawing is shown to be located a spaced distance above the lug windows 404. If desired, the mandrel may also be provided with a smooth bore as at 441, located between the windows 404 and the lock recess 440 spaced thereabove, so that well tools may be landed in the mandrel of the device in much the same manner as they are landed in conventional landing nipples. Thus a well flow control device having lock means and seal means thereon could be disposed in the mandrel so that its lock means would be engaged in the lock recess 440 to anchor the device in place while the seal means would be engaged in the smooth bore 441 to seal between the flow control device and the inner wall of the mandrel in the well-known manner. Such well tools could be plugs, standing valves, flow chokes, safety valves, flow regulators, or the like. The lock mandrel of the well flow control device could be such that it could be stopped by the tool stopping lugs 405 in the correct position so that the locking means of the locking device could be expanded into engagement with the lock recess 440. In this manner, the tool stopping lugs 405 would be facilitating the installation of the well flow control device in the device 400 so that it would be located properly in order that it may be well anchored and also would sealingly engage the smooth bore 441. It is understandable that the lugs 405 in this case would need to project inwardly to a position where they would restrict the bore 441 so that they would be effective to stop the flow control device or other tools passing through the mandrel. Therefore, this device is not restricted to being used with flow control devices but could still be used in the usual manner of stopping well tools passing in either direction through the tubing string at known checkpoints therein so that their progress would be known by the operator.

Further, since the device 400 in FIG. 11 is shown as a normally closed device, that is with the lugs normally locked in their innermost position, the well flow device could be of the no-go type which would be run into the well until they reach a no-go shoulder which in this case would be constituted by the tool stopping lugs 405 which are projecting into the bore 441, and when the flow control device would come to rest on the lugs 405, then their locking means could be actuated to engage the lock recess 440 of the mandrel to anchor the device in place. Thus the device would be supported against downward movement by the lugs which would remain in their innermost position and would be anchored against upward movement or downward displacement from the body of the device by the locking means thereon engaged in the lock recess 440.

Figure 12:
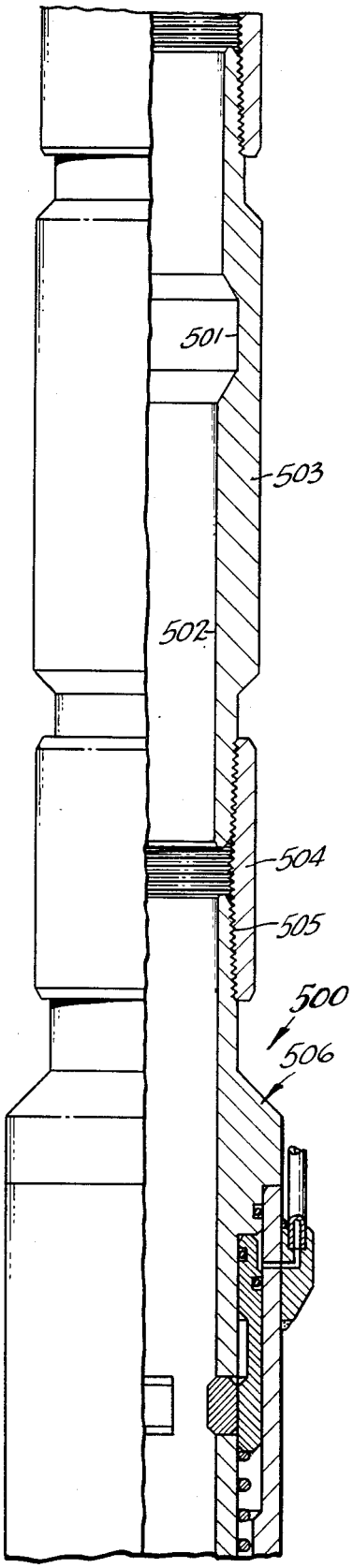
FIG. 12 is a view similar to FIG. 11 but showing a smooth bore and annular locking recess provided in a conventional landing nipple threadedly attached to the upper end of a device such as that shown in FIG. 8.

FIG. 12 illustrates a tool stopping device which is indicated generally by the numeral 500, and this device is very similar to the device 400 of FIG. 11 which was just described, the notable exception being that whereas the lock recess 440 and smooth bore 441 were provided in the body of the device 400 of FIG. 11, a lock recess 501 and a smooth bore 502 of the device 500 are provided in a separate landing nipple 503 which is attached by suitable means such as the threaded tubing collar 504 to the upper end 505 of the tool stopping device 506. The tool stopping device 506 could be exactly like that device shown in FIG. 8 but should preferably have its piston replaced with a piston like that shown in FIG. 8A so that the device would be a normally closed device. In this manner, a device like device 350 in FIG. 8 excepting that it be a normally closed device, could be converted to a device which would perform like that of device 400 of FIG. 11 by adding thereto a landing nipple such as the landing nipple 503 to provide a suitable lock recess such as recess 501 and a suitable smooth bore such as bore 502. The landing nipple 503 could be added to the upper end of the tool stopping device or could possibly be added to the lower end of the device. This of course would depend upon how the flow control device would be constructed. It would seem more desirable generally to have the lock recess and the smooth bore above the tool stopping lugs as is normally the case with flow control devices which have the no-go portion below the locking means on the device.

The device 500 of FIG. 12 would be effective as a tool stopping device in the same manner as the preceding embodiments described and could be used in either of the well systems of FIGS. 1 or 2 inasmuch as the device is still effective to stop tools which approach it from either above or below, but in addition to this, it is able to act as a temporary no-go shoulder to aid in installing well flow control devices in the landing nipple attached to the upper end thereof.

Figure 13:
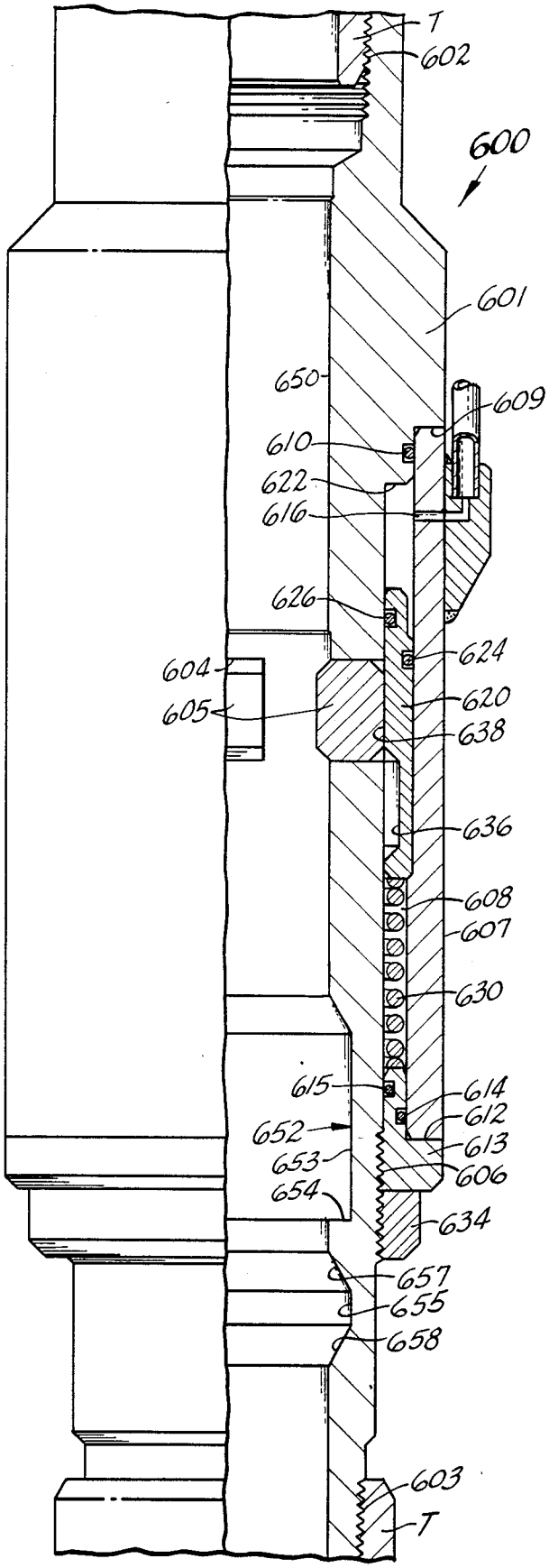
FIG. 13 is a view similar to FIG. 11 and showing a device similar to that of FIG. 11, but having a honed bore above and annular locating recess means below the tool stopping lugs, the annular locating recess means including one upwardly facing abrupt stop shoulder.

The tool stopping device illustrated in FIG. 13 is indicated generally by the numeral 600 and is very similar to the device 400 illustrated in FIG. 11, the main exception being that the device 600 has recess means below the windows thereof and a smooth bore portion above the windows thereof. The device 600 comprises a mandrel or body 601 having means at its opposite ends 602 and 603 for connection to a tubing string T. Intermediate its ends the body 601 is provided with a plurality of lug receiving windows 604 in each of which is disposed a tool stopping lug 605 which is radially movable therein between inner and outer positions in the manner before described with respect to previously described tool stopping lugs. A housing 607 is disposed about the body and is spaced therefrom providing an annular space 608 therebetween. The body 601 is provided with means for closing this annular space 608 at its opposite ends in a manner which will now be described. The upper end of the housing 107 abuts a downwardly facing shoulder 609 on the body and a seal ring 610 carried on the body seals between the body and the housing near the upper end of the housing. The lower end of the housing 607 is supported on an upwardly facing shoulder 612 provided on retainer member 613 which is threaded onto the lower portion of the body as at 606, and this retainer carries a seal ring 614 in a suitable external annular recess. This seal ring seals between the retainer and the lower portion of the housing while an inner annular seal ring 615 carried in a suitable internal recess in the retainer seals between the retainer and the exterior surface of the body as shown. The housing 607 is provided near its upper end with a lateral port 616 which communicates the exterior of the device with the interior of the housing near the upper end of the annular space 608. Within the annular space 608 is mounted an annular piston 620 which is slidable longitudinally therein between upper and lower positions. When the piston is in its uppermost position, its upper end abuts downwardly facing shoulder 622 on the body which is located just below the seal ring 610. When the piston is in this position, the outer seal ring 624 on the piston is positioned just below the lateral port 616 of the housing and is effective to seal between the piston and the housing. An inner seal ring 626 carried by the piston seals between the piston and the exterior of the body. A coil spring 630 is disposed in the annular space 608 below the piston and has its upper end in engagement with and bearing against the lower end of the piston as shown while the lower end of the spring is supported on the upper end of the retainer 613 as shown.

The retainer 613 is secured in place on the mandrel by lock nut 634.

When control pressure admitted into the device through the lateral port 616 of the housing acts upon the pressure responsive surface of the piston, defined by the difference in the areas sealed by the piston seals 624 and 626, and is of sufficient magnitude to overcome the upward force of the coil spring 620, the piston will move down, and when this control pressure is allowed to bleed from the device through the lateral port 616, the coil spring 630 will be effective to return the piston to its uppermost position.

The device shown is of the normally open type but could just as well be of the normally closed type. With the piston 620 installed therein as shown, its lug receiving recess 636 is below the lugs when the piston is in its lowermost position, but when the piston is in its uppermost position, this recess is aligned with the lugs and the lugs are free to move outwardly thereinto to clear the bore through the device for passage of tools therethrough in the manner previously described. When the piston is in the lower position as shown in FIG. 13, the inner wall 638 of the piston confines the lugs 605 to their innermost position in which position they project into and restrict the bore of the device and thus are in position to stop tools, approaching from either direction, from passing through the device.

The device 600 of FIG. 13 is different from the device 400 of FIG. 11 in that the device 600 has its body formed with a smooth bore 650 extending above the lateral windows 604, and this smooth bore wall is engageable by seal means which may be carried on suitable well flow control devices.

Spaced below the lateral window 604 of the body, the body is provided with internal annular recess means such as recess means 652, and such means may comprise an upper recess 653 having an upwardly facing abrupt internal annular shoulder 654 at its lower end, and a lower recess 655 spaced rather closely below the lower end of recess 653. The upper and lower walls of recess 655 are inclined divergently inwardly while the upper wall which represents the upper limit of recess 653 is inclined upwardly and inwardly. This upper wall of the upper recess is indicated by the numeral 656 while the upper and lower walls of lower recess 655 are indicated by the numerals 657 and 658, respectively.

The annular recess means 652 as shown may be like the recess means shown in U.S. Pat. No. 2,673,614 which issued to I. A. Miller on Mar. 30, 1954, or like that shown in U.S. Pat. No. 3,208,531 which issued to Jack W. Tamplen on Sept. 28, 1965, or any other suitable configuration.

The device 600 may function as a tool stopping device in the manner described previously with respect to the other devices, but in addition it is provided with the smooth bore 650 for receiving a seal means on a well flow control device and also has internal recess means 652 which would receive key means on a flow control device. These keys would be similar to the keys on the lock mandrel shown in U.S. Pat. No. 2,673,614 or the device shown in U.S. Pat. No. 3,208,531 mentioned above. Such keys are spring-loaded outwardly and can move outwardly into such recesses so that the downwardly facing abrupt shoulder on the keys would engage the abrupt upwardly facing internal shoulder 654 of the recess means 652 to stop downward movement of the flow control device in the tool stopping device 600. Of course, in order to properly position the tool in the device, the device would need to have its lugs in their outer position, that is, in the device 600 as shown, the piston would need to be in its upper position, that is, with the control pressure not applied thereto but released therefrom. The flow control device would be lowered into the well until the keys thereof engaged the recess means 652 and stopped, thus positioning the seal means thereof in the smooth bore 650 so that the seal means would be effective to seal between the flow control device and the mandrel 601. With the flow control device positioned in the device 600 with the keys thereof engaged with the recess means in the mandrel 601, the control pressure would be applied through port 616 to the piston 620 to cause piston 620 to move downwardly to lock the tool stopping lugs 605 in their innermost position as shown. The lugs 605 would be moved inwardly above an upwardly facing shoulder on the flow control device to limit upward movement of the flow control device from its position of engagement in the device 600 so that it would be anchored in place against displacement therefrom in either longitudinal direction, that is upwardly or downwardly, and with its seal means sealed in bore 650 so that the device would be in position to control flow through the tubing.

Figure 14:
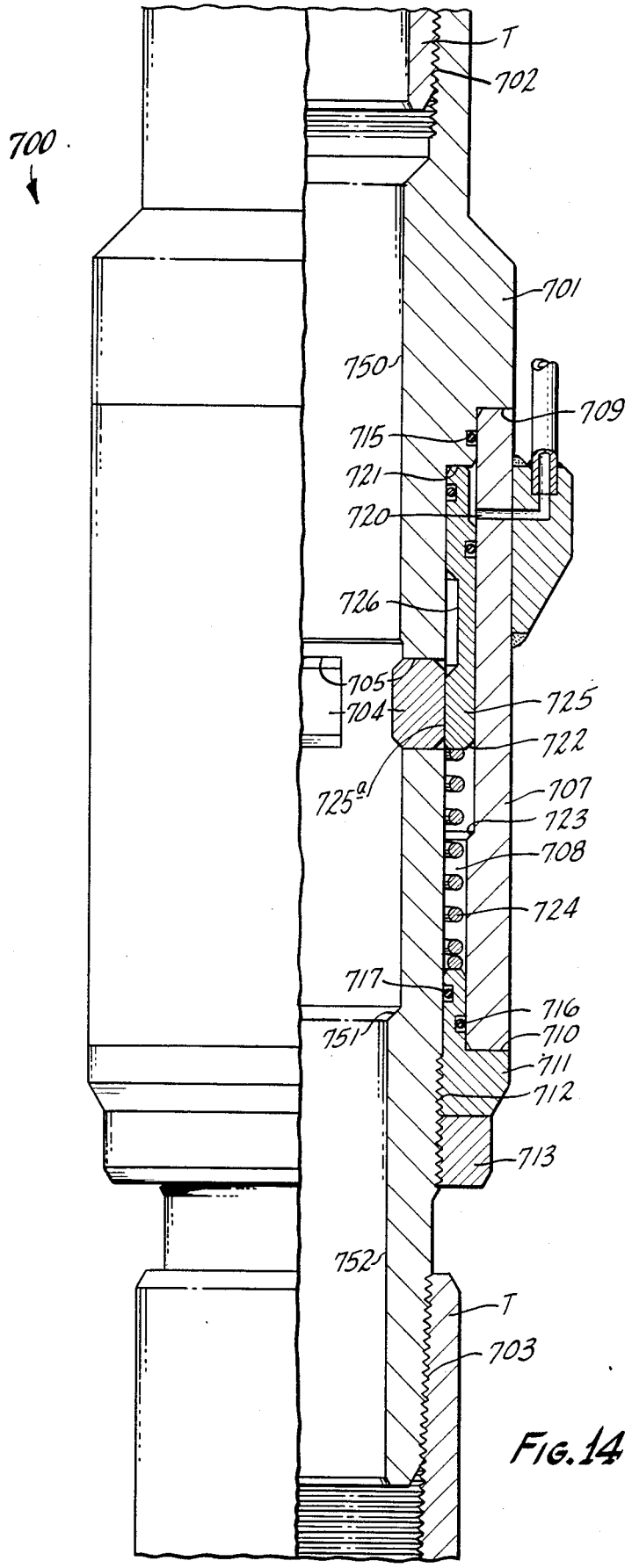
FIG. 14 is a view similar to FIG. 13 showing a device similar to that of FIG. 13, but having a smooth bore above the lugs and an inclined no-go stop shoulder below the lugs.

The device illustrated in FIG. 14 is indicated generally by the numeral 700 and is very similar to the device illustrated in FIG. 13 in use and construction in that it has a body 701 with means 702 and 703 at its opposite ends for attachment to a well tubing string T. Intermediate its ends it is provided with a plurality of lug receiving windows 704, each of which has disposed therein a tool stopping lug 705 which is movable radially between inner and outer positions.

A housing 707 surrounds the body and is spaced therefrom to provide an annular space 708 therebetween, and the body is provided with means thereon for closing the opposite ends of this annular space. Thus the upper end of the housing abuts the downwardly facing shoulder 709 near the upper portion of the body while the lower end of the housing is supported on the upwardly facing shoulder 710 of a retainer 711 attached as by thread 712 to the lower portion of the body and secured in position by a lock nut 713, also threaded onto the mandrel as shown. An annular seal ring 715 carried on the body seals between the body and the upper portion of the housing, and a similar seal ring 716, carried on the retainer 711 seals between the retainer and the lower portion of the housing. A suitable internal seal ring 717 carried by the retainer seals between the retainer and the exterior surface of the body.

A lateral port 720 is provided in the wall of the housing near its upper end, and this lateral port communicates the exterior with the interior thereof. In annular space 708 a piston 725 is longitudinally movable between an upper position in which its upper end abuts downwardly facing shoulder 721 of the body and a lower position in which its lower outer beveled corner 722 engages upwardly facing shoulder 723 in the housing. When in the upper position, the bore wall **725*a* of the piston 725 confines the lugs to their inner position as shown, in which position they are able to stop tools from passing through the device. A lug receiving recess 726 is formed in the annular piston 725, and when the piston is in its lower position just described, this recess 726** is in alignment with the lugs, and the lugs are able to move freely outwardly thereinto to clear the bore through the device so that well tools may freely pass therethrough.

The device 700 can be used as a tool stopping device in systems such as the system illustrated in FIGS. 1 and 2 and can be used to stop tools approaching it from above or from below as desired if lugs 705 project inwardly farther than the bore 752 at the lower end of the body. (As shown, bore 752 is sufficiently small in diameter to provide an upwardly facing no-go shoulder 751.) Devices like that of FIG. 14 can be used to monitor the location of tools in well flow conduits of wells both on their way into the well and also on their return trip out of the well.

The device 700 of FIG. 14 as shown is provided with a smooth bore 750 disposed above the lateral windows 704 and with a no-go shoulder 751 spaced below the windows 704. Because of restricted no-go shoulder 751, such device could be used below other tool stopping devices in a well flow conduit but is not interchangeable with the devices previously described hereinabove.

The body 701 of device 700 is also provided with a smooth bore 752 which extends below the no-go shoulder 751. This device 700 is especially suited to special flow control devices or well tools such as, for instance, a downhole pump which would have a downwardly facing shoulder thereon engageable with the upwardly facing no-go shoulder 751 in the body 701 to limit downward movement of the pump in the device 700. With the pump thus positioned in engagement with the no-go shoulder 751, seal means carried on the pump would then be positioned in engagement with the smooth bore 750 or with the smooth bore 752, or with both, if desired. With the pump thus positioned in the tool stopping device, the tool stopping device could be actuated so that its lugs 705 would be moved inwardly to a position above an enlargement on the pump so that the pump could not move upwardly from the device because of the lugs being closed thereabove. Thus the lugs would limit the upward movement of the pump while the no-go shoulder would limit the downward movement of the pump, and the pump would be secured in the device with the seal means thereof sealingly engaged with the inner wall of the mandrel 701.

It is obvious from this use that the piston 725 would have its tool receiving recess 726 in the position shown so that this device would be a normally closed device. Thus when control pressure is admitted into the device through the lateral port 720, the piston would move down, the internal recess would become aligned with the lugs, the lugs could move outwardly to release position to allow the pump to move into place, after which the actuating pressure would be bled off through the lateral port 720, and the spring 724 would move the piston to its uppermost position shown in FIG. 14 in which position it securely locks the lugs or confines them securely to their inner pump engaging position so that the pump cannot be displaced upwardly from its position in the device.

Of course, if desired, the device 700 could be provided with a piston having its lug receiving recess near its lower end, making the device then a normally open device. This, understandably, would necessitate holding control pressure on the device all the while that the downhole pump is to be locked in place, and this might be for months at a time.

Thus it has been shown that the present invention can be embodied in several different forms of tool stopping devices, some of which are capable of stopping tools in only one direction and others of which are capable of stopping tools in either longitudinal direction. Other embodiments also include means for receiving flow control devices to be locked therein, and in one case, a tool stopping device could be converted from a mere tool stopping device of the type shown in FIG. 8 to one having landing nipple means connected thereto as shown in FIG. 12. Again, it has been shown that these devices can be converted from normally open to normally closed devices. Further, it has been shown that these devices can be placed in tubing strings singly or in quantity. A plurality of devices, it has been shown, can be used in a tubing string in a well, and they can be actuated in unison, control pressure being transmitted thereto through the annulus or through a separate control line which is disposed in the annulus between the tubing and casing, or that a separate control line could be run to each individual device for actuation thereof selectively, if desired, or that a well could contain a plurality of tubing strings and one or a plurality of such tubing strings could contain one or a plurality of tubing stopping devices, and that the devices in any individual tubing string could be connected to a common control line or, if desired, all of the devices in the entire well could be connected to a common control line so that all of them would actuate in unison.

Referring again to FIGS. 1 and 2, it will be seen that a method is provided for monitoring the location of tool strings passing through well flow conduits. These tool strings could either be lowered into the well by wireline or by pumpdown methods, and in such installations, the tool stopping devices would be placed in the tubing string or strings at known locations and the location of such devices would be made of record so that when tools are run into the system or into a tubing string, before such tools arrive at the first checkpoint, or first tool stopping device, the tool stopping device or all of the devices in the system, for that matter, would be actuated to closed position, and when the tools arrived at such checkpoint, they would stop. The operator would know that the tools were stopped because of the wireline stopping or because of the pump pressure increasing suddenly in the case of a pumpdown operation. After the tools stopped and the location thereof noted, the tool stopping device or devices would be actuated to open position, the tools would be allowed to pass therethrough, and then before the tools reached the next checkpoint, the device or devices would be actuated to closed position so that the tools would stop at the next checkpoint and the location thereof noted. Again, after the tools stopped, the tool stopping device or devices would be actuated to open position to allow the tools to pass through and beyond and then stopped at the next successive checkpoint, and so on, until the tools reached their destination. On the return trip from the well, if desired, the device or devices could be actuated to closed position and the tools would stop at the first device that they encountered. The location of the tools would be noted, the device or devices would be actuated to open position, and the tools allowed to pass upwardly therethrough after which the device or devices would be actuated to closed position so that the tools would be stopped at the next successive checkpoint, and so on, until the tools returned to the point of origination. Thus, the location of the tools in the system or in the tubing string could be monitored so that their arrival at these known checkpoints could be known, and with great accuracy, because the location of these devices would be known with great accuracy.

Figure 15:
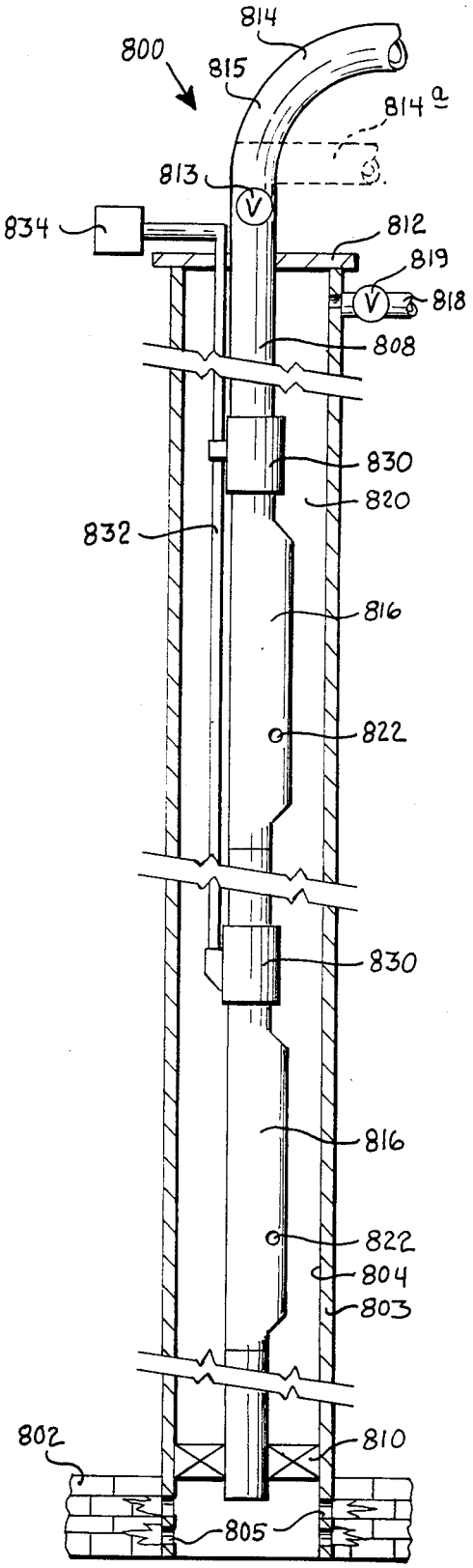
FIG. 15 is a diagrammatical view of a well installation showing a well equipped with a plurality of side pocket mandrels, each equipped with a retractable lug device of this invention at its upper end.

In FIG. 15, a well is indicated generally by the reference numeral 800. The well bore penetrates earth formation 802, and its casing 803 having a bore 804 is perforated as at 805 to provide inlets for production to enter the casing bore 804 from the formation 802. A well tubing string 808 is disposed in the casing 803 and a well packer 810 seals between the tubing and the casing just above the formation. A well head 812 seals the upper end of the casing around the tubing as shown. Well products may enter the casing 803 through the perforations 805 and flow upwardly through the tubing 808 and through the Christmas tree or master valve 813 to the flow line 814 which may be curved as at 815 in the case of a pumpdown well or angular as at **814*a*** in the case of a conventional well.

The tubing string 808 is provided with a plurality of identical side pocket mandrels, two of which are shown and are indicated by the same reference numeral 816.

Each side pocket mandrel 816 has an offset receptacle (not shown) in which a gas lift valve (not shown) can be housed. Lift gas supplied to the well through gas supply line 818 is injected through casing wing valve 819 into the casing 803 at the surface. This lift gas flows down the annulus 820 between the tubing 808 and the casing 803 and enters the lateral port 822 of one of the side pocket mandrels 816 when one of the gas lift valves (not shown) therein is open to aid in lifting the well fluids to the surface.

Each of the side pocket mandrels 816 is equipped with a tool stopping device 830 which is operated by pressurized fluid conducted to it via a control fluid conduit 832 having its upper end connected to a surface control unit 834 which can either pressurize or vent control fluid conduit 832. The device 830 is illustrated in FIGS. 16–22.

Figure 16:
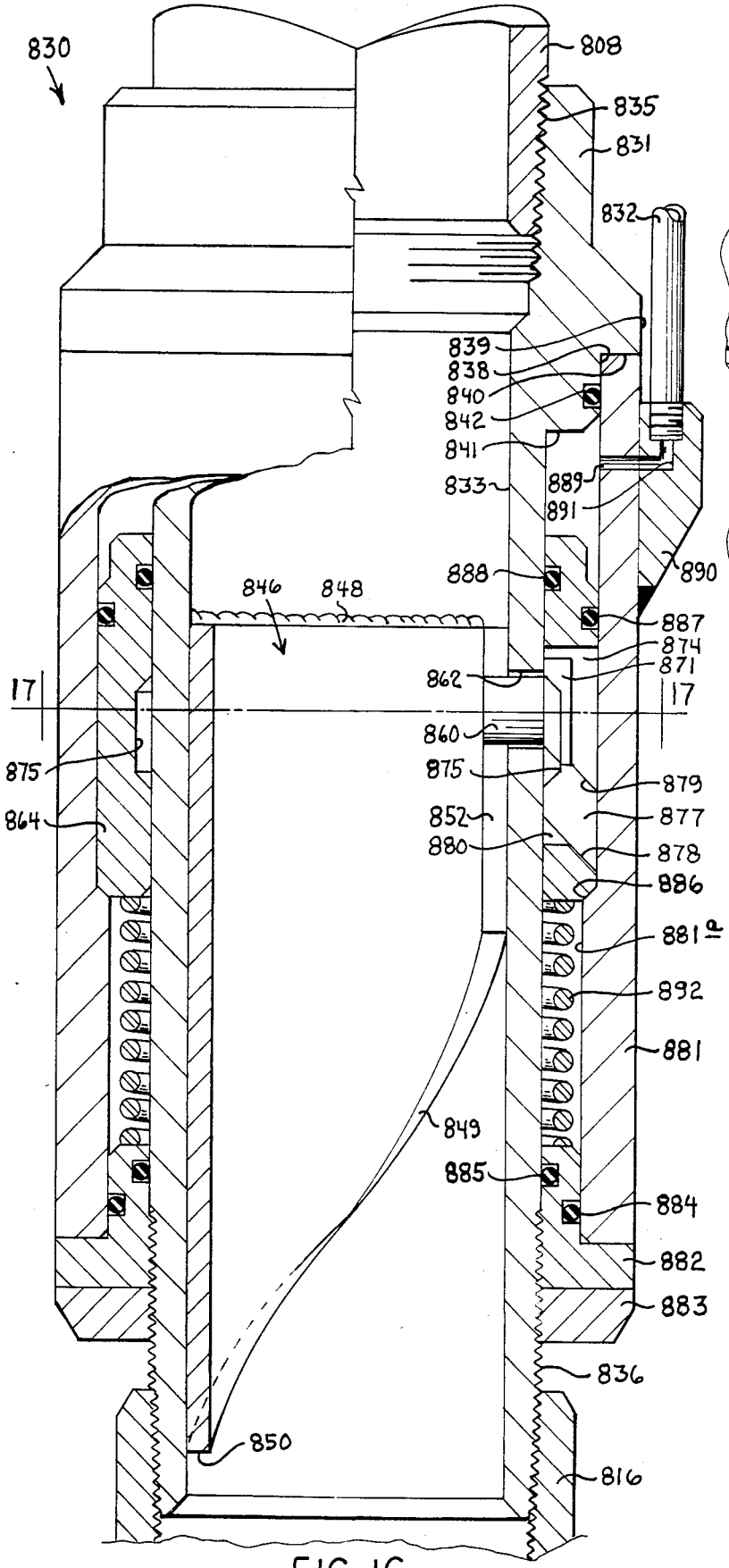
FIG. 16 is a longitudinal view, partly in section and partly in elevation, of a device constructed in accordance with this invention and having an orienting sleeve therein with an orienting slot passing completely therethrough and a remotely actuated lug in its inner position blocking the orienting slot.

Referring now to FIG. 16, it will be seen that the device 830 has a tubular body 831 having a through bore 833 and having means at its upper end, such as thread 835, for attachment to the well tubing 808 and means, such as thread 836, for attachment to the upper end of the side pocket mandrel 816.

The tubular body 831 is enlarged as at 838 and further enlarged as at 839 to provide downwardly facing shoulder 840 and a place for a suitable annular groove for seal ring 842 whose purpose will be later explained.

An orienting sleeve 846 is positioned in the bore 833 of the body and welded in place as by weld 848. The orienting sleeve has a pair of guide surfaces 849 which slope upwardly from its point 850 to its through slot 852. Well tools having a suitable orienting key and approaching the orienting sleeve from below will engage one of the guide surfaces 849 and will be directed into slot 852. If the slot 852 is clear, the key will pass through its entire length and emerge at the upper end of the slot.

As shown in FIG. 16, a lug 860 is disposed in and protrudes through window 862 formed in the wall of the body and in line with slot 852. The lug 860 thus projects into slot 852 as shown, and since the lug is almost as wide as the slot, it effectively blocks the slot a spaced distance from its lower end and is capable of stopping well tools whose orienting keys are guided into the slot. The lug 860 is retractable, in a manner to be described, to a position wherein it does not project into slot 852.

A cam sleeve or piston 864 is slidably mounted about the body 831 and covers the lug 860 at all times. The piston 864 is movable from an upper position shown in FIG. 22 to a lower position shown in FIG. 16. When the piston is in its upper position (FIG. 22), lug 860 is retracted and does not block the slot 852 of the orienting sleeve. When, however, the piston 864 is in its lower position (FIG. 16), the lug 860 projects into and blocks the slot 852 as shown and is, thus, in position to stop a well tool having a suitable orienting key.

The lug 860 is positively cammed inwardly responsive to downward movement of the piston 864 and is positively cammed outwardly upon upward movement of the piston in a manner which will now be described.

Figure 20:
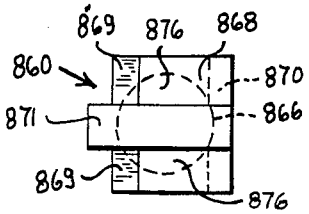
FIG. 20 is an end view of the lug of FIG. 19.
Figure 19:
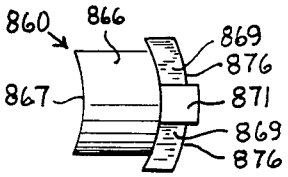
FIG. 19 is a top view of the lug of FIG. 18.
Figure 18:
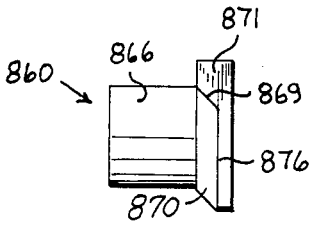
FIG. 18 is a side view of the retractable lug of the device of FIG. 16.
Figure 21:
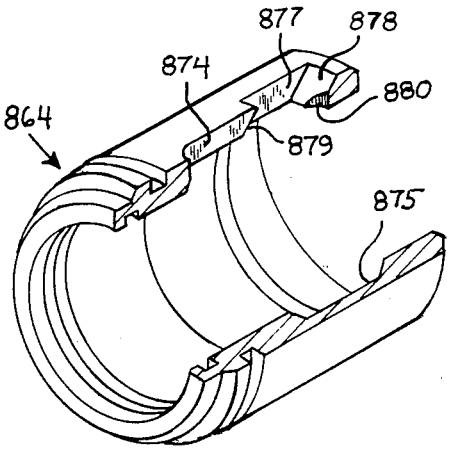
FIG. 21 is a perspective view of the piston of the device of FIG. 16.
Figure 17:
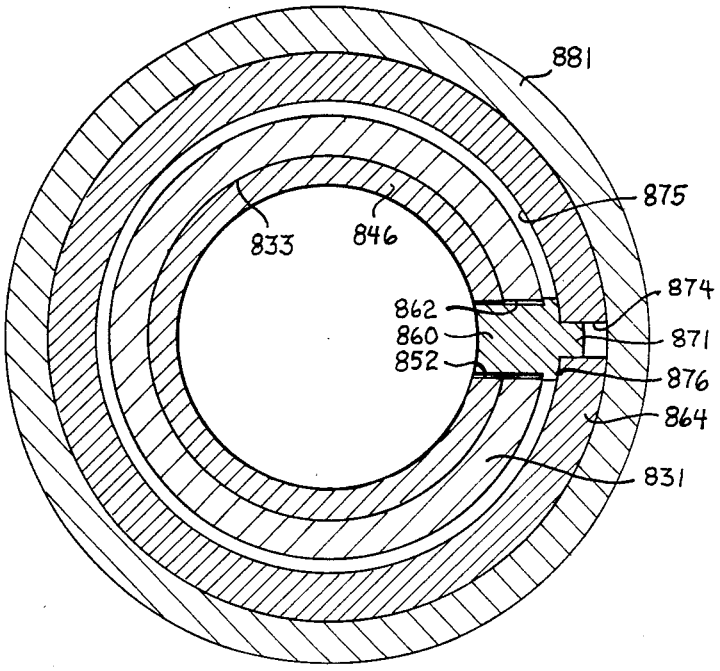
FIG. 17 is a cross-sectional view taken along line 17—17 of FIG. 16.
Figure 23:
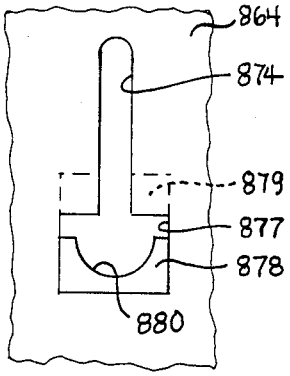
FIG. 23 is a fragmentary side view of the piston of the device of FIG. 16 showing the slot and cam window thereof.
Figure 25B:
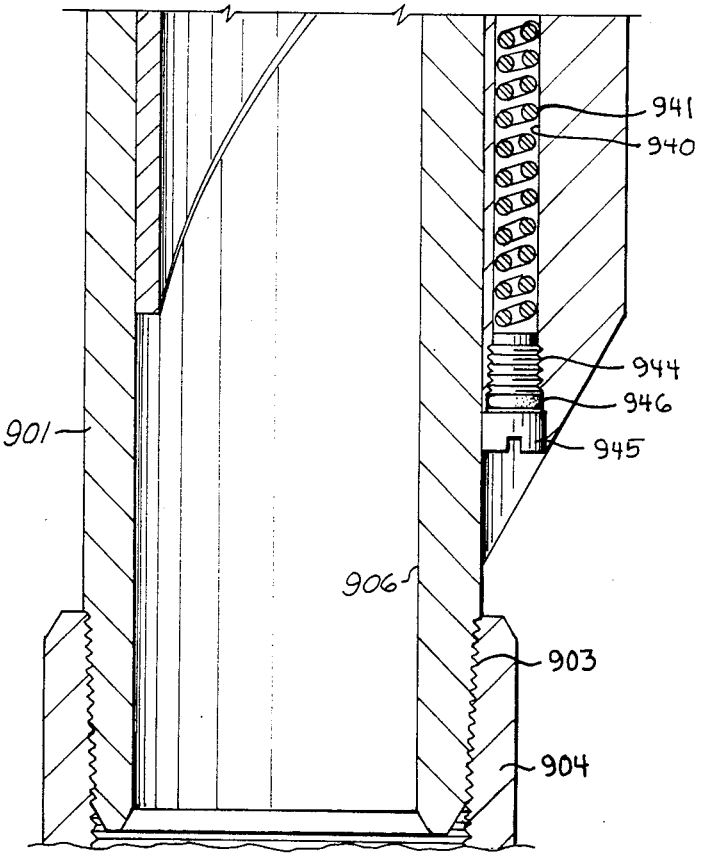
FIGS. 25A and 25B, taken together, constitute a longitudinal view, partly in section and partly in elevation, showing a releasable orienting device constructed in accordance with the present invention, this embodiment being a modified form of the device shown in FIGS. 16–23.

In FIGS. 18–20, the lug 860 is shown. Its pin portion 866 is shown cylindrical for the sake of simplicity. It may preferably be square or rectangular. The inner end of the lug may be contoured as at 867 (FIG. 19) if desired to conform with the bore of the orienting sleeve, as seen in FIG. 17. The lug is formed with a rectangular head 868 having upper and lower edges which slope outwardly and downwardly as at 869 and 870, respectively, which constitute cam surfaces for camming the lug inwardly and outwardly, respectively.

The lug 860 is preferably formed with a key portion 871 which constitutes a ridge or rib extending vertically across the center of head 868 and extends a short distance thereabove. The key 871 also extends outwardly of the head.

The piston 864 is provided with a vertical slot 874 which receives the key 871. This key-slot arrangement is not necessary but assures proper orientation of the lug 860 with the piston 864.

An internal recess 875 is formed in the piston 864, as shown, to accommodate the lateral portions 876 of the lug head 868 when the piston is in its lower position. In this position, the inner wall of recess 875 is engageable with such lateral portions 876 and maintains the lug 860 in its inner position and prevents outward movement thereof.

Figure 22:
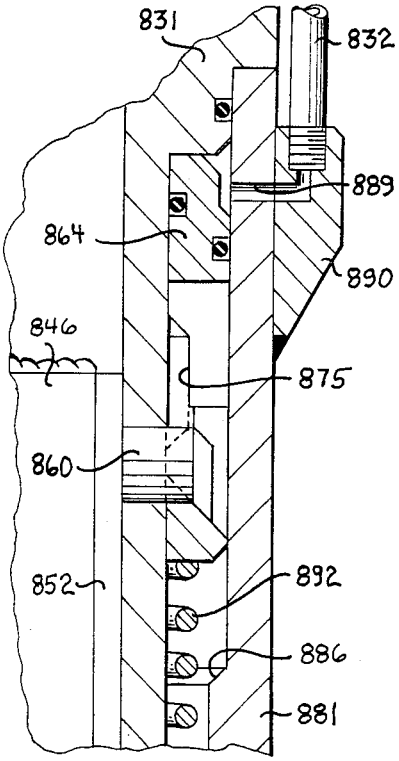
FIG. 22 is a fragmentary view of a portion of the device of FIG. 16 showing the lug thereof retracted.

The vertical key slot 874 of the piston opens into a cam slot 877 which is sufficiently wide to receive the head 868 of the lug. The upper and lower limits of the cam slot are inclined upwardly and inwardly providing a lower cam surface 878 and an upper cam surface 879 as shown. Cam surface 878 coacts with cam surface 870 of the lug to positively cam the lug outwardly to retracted position as seen in FIG. 22 upon upward movement of the piston, and cam surface 879 coacts with cam surface 869 on the lug to cam the lug inwardly to orienting slot blocking position seen in FIG. 16 upon downward movement of the piston. Since the lower cam surface 878 would otherwise contact the pin portion 866 of the lug before the lug was retracted fully, this cam surface must be formed with a semicircular notch or recess 880.

Thus, when the piston 864 is moved downwards, the lug 860 is moved inwards, and when the piston moves upwards, the lug is moved outwards.

A cylinder or housing 881 surrounds and is spaced from the body forming an annulus **881*a* therebetween in which the piston 864 is housed. The upper end of the housing 881 fits over the intermediate diameter 838 of the housing and is sealed by seal ring 842 while the upper end of the housing abuts downwardly facing shoulder 840 provided by enlargement 839 of the body. Seal ring 842 seals the upper end of annulus 881*a***.

The housing 881 is retained in place on the body by nut 882, as shown, attached to the body by thread 836 and securely locked in place by lock nut 883. Nut 882 carries an external seal ring 884 having sealing contact with the housing and in internal seal ring 885 having sealing contact with the outer surface of the body 831. These two seal rings, 884 and 885, seal the lower end of annulus **881*a***.

The housing 881 is provided with an upwardly facing shoulder 886 which is engageable by the piston 864 to limit its downward movement while upward movement of the piston is limited by abutment of its upper end with the downwardly facing shoulder 841 of the body 831 provided by enlargement 838.

The piston carries two seal rings in suitable annular grooves. Outer seal ring 887 seals between the piston and the housing, and internal seal ring 888 seals between the piston and the body as shown.

The housing 881 is provided with a lateral aperture or port 889 near its upper end, and a boss 890 having an L-shaped passage 891 therethrough is welded to the exterior of the housing with the L-shaped passage communicating with port 889. The L-shaped passage 891 of boss 890 is adapted to receive the lower threaded end of control fluid conduit 832 as shown. Thus, pressurized control fluid is conducted from the surface through control fluid conduit 832 to the boss 890 and through housing port 889 into the annulus **881*a* above piston 864 to act upon its pressure responsive area defined by the area sealed by seal ring 887 minus the area sealed by seal ring 888. When control pressure is of sufficient value, piston 864 will be forced from its upper position, shown in FIG. 22, to its lower position, shown in FIG. 16**.

Coil spring 892 is disposed in annulus 881*a* below the piston and is supported on the upper end of nut 882 while its upper end engages and applies an upward bias to the piston. When control pressure is bled from above the piston, spring 892 will lift the piston from its lower to its upper position.

In the manner described hereinabove, application of control pressure will force the piston 864 down and cause the lug 860 to be cammed to its innermost position. Release of control pressure will allow spring 892 to lift the piston and cause the lug 860 to be retracted. In this manner, the orienting slot 852 of the orienting sleeve 846 of each of a plurality of side pocket mandrels may be blocked or unblocked by retractable lugs so that an orienting type kickover tool can be used in any selected one of such plurality of mandrels. Thus, an orienting kickover tool which has been lowered into a well below one or all of the side pocket mandrels 816 may be safely withdrawn to the surface without activating the same merely by retracting all of the lugs 860 by application of control pressure to control line 832 and then withdrawing the kickover tool. In the same manner, the kickover tool could be lifted past any number of side pocket mandrels to a selected one in which it is to be used. In this case, control pressure would be applied to control conduit only just before the kickover tool reached the selected side pocket mandrel from below.

It should be understood that the device 830 described hereinabove and illustrated in FIGS. 16–23 has utility other than for orienting kickover tools in side pocket mandrels. For instance, one or more of the device 830 could be made up in one or more of a plurality of tubing strings for orienting a perforating gun in one of the tubing strings with respect to the other strings of tubing so that the bullet or jet shot from the gun would be directed away from the other tubing strings to avoid damage thereto which would be very costly in time and money.

Since side pocket mandrels have a belly causing a considerable bulge on one side thereof, and since the device 830, due to its concentric structure, projects outwardly in all directions, the combination of device 830 and a side pocket mandrel can be run only in well casing of appreciable internal diameter. It may be desirable to run such combination devices in somewhat smaller existing well casings.

Further, it is often desirable to run side pocket mandrels in dual tubing strings and to run such dual tubing strings in casing which is as small as possible. For such use, side pocket mandrels having an oval cross section (rather than round) are available. The use of the device 830 on such oval side pocket mandrels would defeat their purpose, for oval mandrels so equipped would not be able to pass each other or even be installed at all except in extremely large sizes of casing.

In FIGS. 24–27, there is illustrated a device 900 which serves the same purpose as does the device 830, but because it has an eccentric piston, its cross section is oval and approximates that of an oval side pocket mandrel. Thus, the device does not project outwardly beyond the periphery of the oval side pocket mandrel to which it is attached. Therefore, it can be used wherever oval side pocket mandrels are used.

Figure 24:
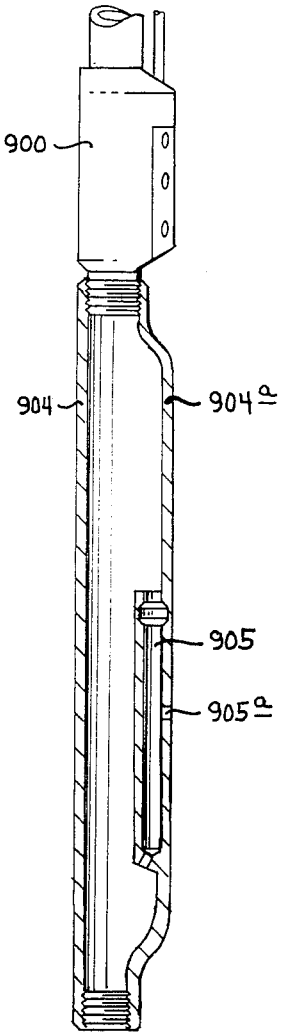
FIG. 24 is a longitudinal view, partly in section and partly in elevation, showing a side pocket mandrel to the upper end of which is attached a releasable orienting device.
Figure 25A:
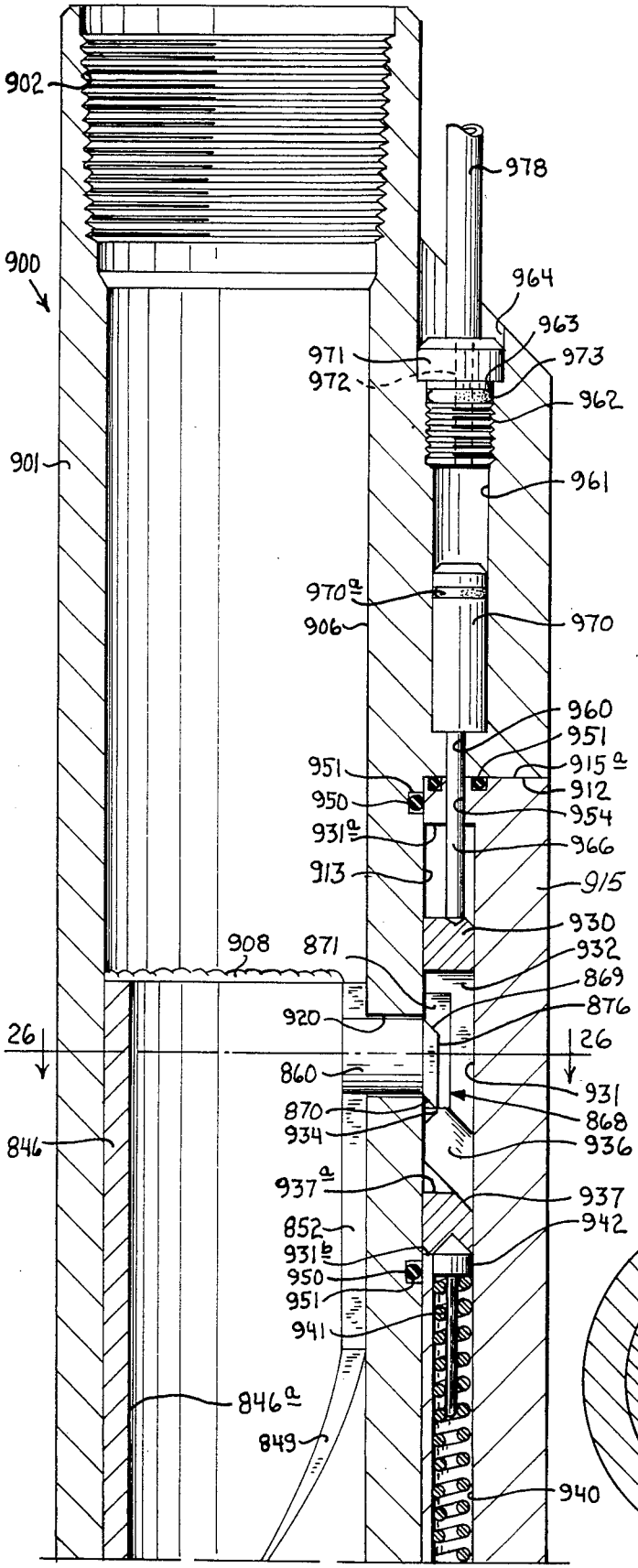
Figure 27:
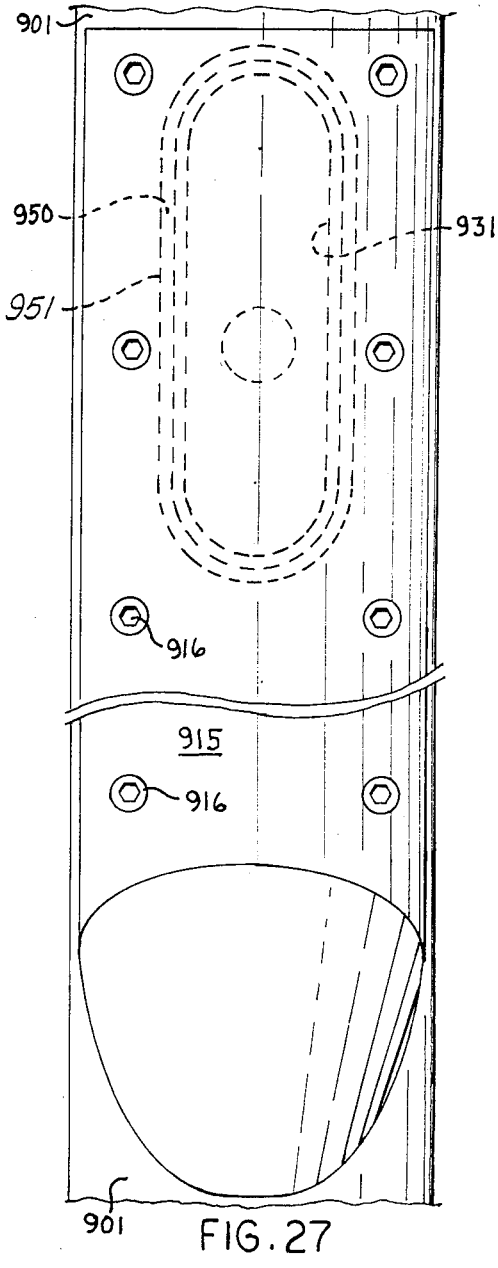
FIG. 27 is a fragmentary side view of a portion of the device of FIG. 25A.
Figure 26:
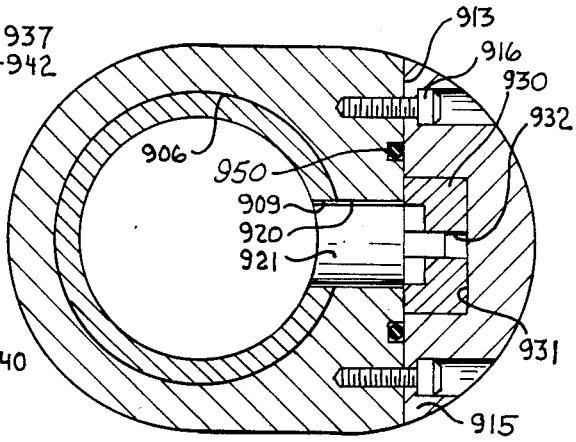
FIG. 26 is a cross-sectional view taken along line 26—26 of FIG. 25A.

Device 900 has a body 901 of oval cross section but preferably having its ends reduced as shown to provide proper connections such as threads 902 and 903 by which it may be attached to the upper end of a side pocket mandrel 904 and to a string of well tubing. These threads are concentric with the body's main bore 906 which provides a through passage axially alignable with the bore of the tubing. Side pocket mandrel 904 is formed with an offset belly 904*a* and an offset receptacle bore 905 having a lateral port 905*a* in its wall communicating the exterior of the mandrel with the receptacle bore, as shown in FIG. 24.

An orienting sleeve 846 having a bore 846*a* is secured in bore 906 as by welding at 908. The orienting sleeve 846 may be exactly like sleeve 846 of the device 830 of FIG. 3, previously described. The orienting sleeve 846 is provided with an orienting slot 852 and with a guide surface 849 below the slot and directed spirally upwards toward the lower end of the slot. The slot extends longitudinally through the sleeve as shown.

Bore 906 is concentric with the arcuate surface 901*a* at one side (or end) of the oval of the cross section of the body, thus leaving considerable material on the opposite side of the body for housing its mechanism as will now be explained.

The body is provided with a downwardly facing shoulder 912 and a vertical flat surface 913 which runs out at its lower end. The notch or recess thus formed receives the filler block 915 which is secured in place by a plurality of screws 916 as shown.

The body 901 is provided with a lateral window 920 in which lug 860 is disposed for reciprocable radial movement therein. Lug 860 may be exactly like and serves the same purpose as lug 860 previously described. Lug 860 projects into and blocks the orienting slot 852 of sleeve 846 but is retractable by remotely actuable means to a position in which it clears the slot completely.

Lug 860 has a head portion 868 on its outer end which has a key 871 and cam surfaces 869 and 870 as shown and as before explained.

A cam block 930 is disposed in cavity 931 of filler block 915 and has a longitudinal slot 932 in which is received the key 871 of lug 860. Cam block 930 further is provided with an inner recess 934 which accommodates the head 868 of the lug except for its key 871 which is disposed in slot 932 as just mentioned. In this position, the inner wall 934 is engageable with the surface 876 of the lug head to hold the lug in its inner position shown.

Cam block 930 is provided with a cam window 936 having its lower end inclined inwardly and upwardly as at 937 to provide a ramp or cam surface which is engageable with cam surface 870 of the lug to force the lug to retracted position (not shown) as a result of cam block 930 moving upwardly from its lower position, shown. Cam surface 937 has a semi-circular notch 937*a* formed therein to accommodate the cylindrical portion of the lug as the cam surface moves the lug to fully retracted position.

The upper end of cam window 936 of the cam block 930 is inclined inwardly and upwardly as at 938 to provide a cam surface which is engageable with cam surface 869 on the lug to cam the lug from its outer to its inner position upon downward movement of the cam block.

Upward and downward movement of the cam block 930 in the cavity 931 of filler block 915 is limited by the upper and lower ends 931*a* and 931*b*, respectively, of the filler block.

The filler block 915 is provided with a bore 940 which has its upper end opening into cavity 931, as shown. Its lower end may open at the lower end of the filler block as shown, if desired. A spring 941 is disposed in bore 940 and applies an upward bias to cam block 930 tending to move it upwardly to its upper position (not shown). Preferably, a suitable plunger 942 is interposed between the spring and the cam block with its upper end engaged in a suitable recess, as shown, to maintain proper alignment of the upper end of the spring relative to the cam block. If the lower end of bore 940 is open, it is preferably threaded as shown at 944 to receive a screw 945 having a seal ring such as o-ring 946 for sealing the bore 940 to prevent leakage of fluids between the interior and exterior of the device through window 920, cavity 931, and bore 940.

Additional seals are provided to prevent leakage between the body 901 and the filler block 915.

Resilient seal 950 is disposed in a suitable seal ring groove 951, formed in filler block 915 and surrounding cavity 931 or formed in the body 901 as shown, for sealing around the edge of cavity 931. A resilient seal ring such as seal ring 951 is disposed in a suitable seal ring groove formed in the upper end face 915*a* of filler block 915 surrounding vertical hole 954 to seal between the upper end of the block and the body.

The body 901 is provided with eccentric bore 960 which is coaxially aligned with hole 954 of the filler block as shown. Bore 960 is enlarged as at 961 to provide a polished bore for piston 970. Bore 961 is threaded as at 962, further enlarged as at 963 and enlarged yet further as at 964, as shown.

Piston 970 carries a seal ring 970*a* and is disposed in bore 961 for longitudinal movement therein. Push rod 966 extends from piston 970 through body bore 960 and filler block hole 954 into cavity 934 where its lower pointed or rounded end is engaged in an indentation in the upper end of cam block 930. Thus, when the piston 970 moves downwards, the push rod 966 will push cam blocks 930 downwards to cam the lug 860 inwardly to slot blocking position, shown in FIG. 25. The push rod may make similar contact with piston 970 or it may be formed integral with the piston, as desired.

A fitting 971 having a longitudinal fluid passage 972 therethrough is screwed into thread 962 of bore 961 and is tightened against the shoulder provided where bore 963 enlarges to become bore 964. Seal ring 973 carried in a suitable groove encircling fitting 971 engages the wall of bore 963 and seals this threaded connection.

Fluid pressure from exterior of the device 900 is admitted into bore 961 of body 901 to act upon the upper side of piston 970, and when this pressure is of sufficient value, it will force the piston 970 down, pushing cam block 930 down and forcing lug 860 to its inner position, blocking orienting slot 852 of orienting sleeve 846. When this fluid pressure is released, spring 941 will lift cam block 930 and will push the piston back to its upper position, retracting lug 860 to clear orienting slot 852.

Thus, the device may be actuated by fluid pressure in the annulus exterior of the tubing and conducted into bore 961 through fitting 971 to act against the upper end of piston 970.

It is to be understood that well pressure in bore 906 of the body acts at all times against the lower end of piston 970, being transmitted thereto through window 920, cavity 931, hole 954, bore 960 and bore 961.

Since fluids in the annulus may carry grit, sand, scale, or other solid particles, it is generally desirable to provide a control fluid conduit such as conduit 978 having its lower end sealingly, attached to fitting 971 and extending to the earth's surface where its upper end is attached to suitable surface control means including a source of fluid pressure. Thus, clean oil can be used in the system to make the devices much more reliable and trouble-free.

It should be understood also that the control fluid used in remote actuation of device 900 is preferably a light oil and that spring 941 must store sufficient energy to lift cam block 930 to retract lug 860 and in so doing must also lift piston 970 against the hydrostatic head of the column of control fluid which acts upon the areas sealed by piston seal ring 970. Of course, any pressure in bore 906 of the device also acts upwardly against the piston and helps to lift it. It is reasonable then that the piston 970 should be rather small in diameter.

For instance, if the device is located at a depth of 5,000 feet in a gas lift well, the lift gas pressure is 750 pounds per square inch at that depth while the pressure in the tubing is 650 pounds per square inch, the control line is filled with diesel fuel having a gradient of 0.36 pounds per foot of depth, and the piston is $\frac{1}{4}$ inch (0.25") in diameter having an area of 0.0491 square inch, then:

The downward force on the piston when control pressure is bled off at the surface is equal to $5000 \times 0.36 \times 0.0491$, or 88 pounds. The upward force on the piston as a result of tubing pressure equals $650 \times 0.0491$, or 32 pounds. The difference in these two forces is 88 minus 32, or 56 pounds.

Thus, the spring must overcome this differential force of 56 pounds load and also overcome the drag of the cam block, lug, piston seal, and the like, and still have some energy in reserve. A spring force of 70 pounds with the cam block in its upper position should be sufficient. Then, the spring should be sufficiently long to prevent its load being excessively high when the cam block is in its lower position.

Thus, it has been shown that the devices, systems, and methods of this invention fulfill all of the objects which have been set forth above in this application, but it should be understood that variations in the sizes and arrangement of parts and the arrangement of devices in the system, including not only the well tubings, but also the flow lines and the way that the control pressure is transmitted thereto and the way that the methods of operation of the system are performed, may be had without departing from the true spirit of this invention.

We claim:

1. A device for stopping well tools moving through a well flow conduit, comprising:

a. tubular housing means connectable in said well flow conduit in axial relation therewith and having an annular inclined cam shoulder therein and a lateral port in the wall thereof;

b. sleeve means in said housing movable longitudinally relative to said cam shoulder, said sleeve having a plurality of windows;

c. a plurality of tool stopping lugs carried in the windows of said sleeve means and movable radially between inner tool engaging and outer tool releasing positions;

d. resilient spring means having one end thereof supported by said housing means and the other end thereof engaged with and yieldably urging said sleeve means in a first direction to cause said lug means to move to one of said inner and outer positions;

e. pressure responsive means including a piston on said sleeve means and having a pressure responsive surface thereon for moving said sleeve in the opposite direction to cause said lug means to be moved to the other of said inner and outer tool engaging positions, said pressure responsive means being responsive to fluid pressure transmitted into said housing means from exterior thereof through said lateral port;

f. first resilient seal means sealing between said piston and said housing means below said lateral port;

g. second resilient seal means sealing between said sleeve means and said housing means above said lateral port, the difference between the areas sealed by said first and second seal means defining said pressure responsive surface of said piston; and h. means on said sleeve means and said housing means coengageable to limit longitudinal movement of said sleeve means relative to said housing means.

2. The device of claim 1 wherein said resilient biasing means yieldably maintains said sleeve means in position to allow said lug means to move to tool releasing position when pressure acting on said pressure responsive means is insufficient to overcome said biasing means.

3. A device for stopping well tools moving through a well flow conduit, comprising:

a. tubular mandrel means connectable in a well flow conduit in coaxial relation therewith and having at least one lug-receiving window in the wall thereof;

b. lug means including a tool engaging lug in each said at least one window movable radially therein between inner tool engaging and outer tool releasing positions;

c. housing means surrounding at least a portion of said mandrel means and spaced therefrom providing an annular space therebetween, said housing means having a lateral port in its wall;

d. means on said mandrel means closing opposite ends of said annular space;

e. cam sleeve means in said annular space movable longitudinally relative to said lug means and having cam means thereon engageable with said lug means for moving said lug means to inner tool engaging position;

f. resilient means biasing said cam sleeve means longitudinally in one direction; and g. pressure responsive means for moving said cam sleeve means longitudinally in the other direction in opposition to said biasing means, said pressure responsive means being responsive to fluid pressure transmitted into said annular space from exterior of said housing means through said lateral port.

4. The device of claim 3 wherein said mandrel means is provided with a plurality of lateral windows and a tool engaging lug is mounted for radial movement in each of said plurality of windows between inner tool engaging and outer tool releasing positions, and said cam means is an annular inclined cam surface in said cam sleeve engageable with said plurality of lugs to cam said lugs to inner tool engaging position upon relative longitudinal movement of said cam sleeve means.

5. The device of claim 4, including: shoulder means on said mandrel means and said housing means engageable with said cam sleeve means to limit longitudinal movement of said cam sleeve means relative to said mandrel means and said housing means, and wherein said resilient biasing means is a spring supported at one of its ends by said mandrel means and having its other end engaged with said cam sleeve means and yieldably urging said cam sleeve means to move longitudinally relative to said lug means, and wherein said pressure responsive means includes a piston on said cam sleeve means having a pressure responsive surface thereon exposed to fluid pressure transmitted into said annular space from exterior of said housing means through said lateral port, and said device further includes:

a. first resilient seal means sealing between said piston and said housing means below said lateral port; and b. second resilient seal means sealing between said cam sleeve and said mandrel means above said lateral port, the difference between the areas sealed by said first and second seal means defining said pressure responsive surface of said piston means.

6. The device of claim 3, 4, or 5 wherein said resilient biasing means yieldably maintains said cam sleeve means in position to release said lug means for movement to tool releasing position when pressure acting on said pressure responsive means is insufficient to overcome said biasing means.

7. A device for stopping well tools moving through a well flow conduit, comprising:

a. tubular mandrel means connectable in a well flow conduit in coaxial relation therewith, said mandrel means including:

i. internal annular lock recess means therein engageable by locking dogs of a well tool, and ii. window means including at least one lateral window in the wall thereof spaced longitudinally of said lock recess means;

b. lug means including a tool engaging lug in each said at least one window movable radially therein between inner tool engaging and outer tool releasing positions;

c. housing means surrounding at least a portion of said mandrel means and spaced therefrom providing an annular space therebetween, said housing means having a lateral port in its wall;

d. means on said mandrel means engageable with said housing means and closing opposite ends of said annular space;

e. cam sleeve means in said annular space movable longitudinally relative to said lug means and having cam means thereon engageable with said lug means for moving said lug means to inner tool engaging position;

f. resilient means biasing said cam sleeve longitudinally in one direction;

g. pressure responsive means for moving said cam sleeve means longitudinally in the other direction in opposition to said biasing means, said pressure responsive means being responsive to fluid pressure transmitted into said annular space from exterior of said housing means through said lateral port; and h. means on said mandrel means and means on said housing means engageable with said cam sleeve means to limit relative longitudinal movement of said cam sleeve means.

8. The device of claim 7 wherein said lock recess means is located above said window means.

9. The device of claim 7 further including a smooth bore portion in said mandrel means engageable by seal means on said well tool when said well tool is positioned in said device and its locking dogs are engaged in said lock recess means.

10. The device of claim 9 wherein said smooth bore portion is located between said lock recess means and said window means.

11. The device of claim 10 wherein said mandrel means comprises two mandrel members connected together in axial alignment, said lock recess means and said smooth bore portion being located in one of said two mandrel members and said window means and said lug means being located in the other mandrel member.

12. The device of claim 7 wherein said lock recess means includes an abrupt upwardly facing shoulder for stopping descent of a well tool through said well conduit and said lug means is engageable with said well tool to anchor the same against upward movement out of said device.

13. The device of claim 12 wherein said lock recess means is located below said window means and said mandrel means includes a smooth bore portion located above said window means engageable by seal means on said well tool when said well tool is engaged with said abrupt upwardly facing shoulder of said lock recess means.

14. The device of claim 7, 8, 9, 10, 11, 12, or 13 wherein said resilient biasing means yieldably maintains said sleeve means in position allowing said lug means to move to tool releasing position when pressure acting on said pressure responsive means is insufficient to overcome said biasing means.

15. A device for stopping well tools moving through a well flow conduit, comprising:

a. tubular mandrel means connectable in a well flow conduit in coaxial relation therewith, said mandrel means including:
   i. internal annular upwardly facing no-go shoulder means therein engageable by downwardly facing shoulder means of a well tool to stop descent of said well tool in said conduit, and
   ii. window means including at least one lateral window in the wall thereof spaced longitudinally above said no-go shoulder means;
b. lug means including a tool engaging lug in each said at least one window movable radially therein between inner tool engaging and outer tool releasing positions;
c. housing means surrounding at least a portion of said mandrel means and spaced therefrom providing an annular space therebetween, said housing means having a lateral port in its wall;
d. means on said mandrel means engageable with said housing means and closing opposite ends of said annular space;
e. cam sleeve means in said annular space movable longitudinally relative to said lug means and having cam means thereon engageable with said lug means for moving said lug means to inner tool engaging position;
f. resilient means biasing said cam sleeve longitudinally in one direction;
g. pressure responsive means for moving said cam sleeve means longitudinally in the other direction in opposition to said biasing means, said pressure responsive means being responsive to fluid pressure transmitted into said annular space from exterior of said housing means through said lateral port; and
h. means on said mandrel means and means on said housing means engageable with said cam sleeve means to limit relative longitudinal movement of said cam sleeve means.

16. The device of claim 15 wherein said mandrel means includes a smooth bore portion located above said window means and is engageable by seal means carried on said well tool when said downwardly facing shoulder of said well tool is engaged with said no-go shoulder means in said device.

17. The device of claim 15 or 16 wherein said resilient biasing means yieldably maintains said cam sleeve means in position to allow said lug means to move to tool releasing position when pressure acting on said pressure responsive means is insufficient to overcome said biasing means.

18. A well system for releasably stopping well tools at one or more checkpoints in a well flow conduit, comprising:

a. a well bore;
b. well tubing means including at least one tubing string in said well bore;
c. a well casing surrounding said tubing means and providing an annulus therebetween;
d. packer means sealing between said tubing means and said well casing;
e. tool stopping means comprising a plurality of tool stopping devices in said tubing means, each such tool stopping device having a lateral port and lug means therein movable between tool releasing and tool stopping positions and being actuated by fluid pressure admitted thereto from exterior thereof through said lateral port;
f. a source of pressurized fluid at the earth's surface;
g. conduit means connecting said source of pressurized fluid with said lateral port of each said tool stopping device for communicating pressurized fluid to each such device; and
h. control means connected between said conduit means and said source of pressurized fluid for controlling application of fluid pressure to each said tool stopping device to actuate said lug means thereof to inner tool stopping position to stop well tools thereat and for releasing said fluid pressure to release said lug means for movement to outer tool releasing position to free said well tools for movement therepast.

19. The system of claim 18 wherein said conduit means connecting said source of pressurized fluid with the lateral port of each of said plurality of tool stopping devices is the annulus between said well casing and the exterior of said tubing means above said packer.

20. The system of claim 19 wherein said conduit means connecting said source of pressurized fluid with the lateral port of each said tool stopping device is disposed in but fluidly isolated from said annulus between said well casing and said tubing means.

21. The system of claim 20 wherein a single eccentric control fluid conduit connects said source of pressurized fluid to all of said plurality of tool stopping devices in any individual one of said at least one tubing string in the well to cause such devices to be actuated simultaneously when pressurized fluid is transmitted thereto through said single control fluid conduit.

22. The system of claim 21 wherein said tubing means includes plural tubing strings, said tool stopping means includes at least one tool stopping device in at least two of said plural tubing strings, and pressurized fluid for actuation of all such devices is conducted thereto through a single control fluid conduit.

23. A well system for releasably stopping well tools at known checkpoints in a well flow conduit, comprising:

a. a well bore penetrating a plurality of subterranean earth formations;
b. well flow conduit means including plural strings of well tubing in said well bore each having its lower end in fluid communication with a separate one of said formations;

c. a well packer sealing between said well bore and each said well tubing above each said formation;

d. at least one tool stopping device in each of at least two of said plurality of well tubing strings, each said at least one tool stopping device having fluid pressure actuated releasable tool engaging means therein, each such device comprising:

i. a housing connected in one of said plural strings of well tubing in coaxial relation therewith and having a lateral port in its well communicating its interior with its exterior;

ii. a plurality of tool stopping lugs in said housing movable radially between tool engaging and tool releasing positions;

iii. means for moving said lugs between tool releasing and tool engaging positions;

iv. spring means for biasing said moving means longitudinally in one direction;

v. pressure responsive means including a piston in said housing add having a pressure responsive area thereon, said piston being associated with said moving means for moving said moving means longitudinally in the other direction when fluid pressure exterior of said housing and transmitted to said pressure responsive area of said piston through said lateral port reaches a magnitude sufficient to overcome said resilient biasing means, said pressure responsive means further including a single control conduit in said well bore alongside said plural strings of well tubing and being fluidly connected to said lateral port of each said at least one tool stopping device and also being fluidly connected to a source of fluid pressure at the earth's surface.

24. A method of stopping well tools at at least one checkpoint or known location in a well flow conduit, comprising the steps of:

a. providing a well bore lined with well casing;

b. connecting a well packer to a well tubing string;

c. connecting a plurality of fluid pressure actuated releasable tool stopping devices in said well tubing string above said packer, each said tool stopping device having tool engaging means therein and pressure responsive actuating means for actuating the same and a lateral port in the wall thereof for conducting fluid pressure thereto for actuation thereof;

d. installing said well tubing string in said well bore with said packer sealing between said well bore and said tubing;

e. providing a source of fluid pressure at the earth's surface;

f. fluidly communicating said source of pressure with the lateral port of each said at least one tool stopping device;

g. moving a well tool into said well conduit;

h. actuating said plurality of tool stopping devices by applying fluid pressure thereto from the surface to stop said well tool at the first one of said at least one checkpoint, and releasing fluid pressure from said plurality of tool stopping device to release said well tool stopped thereby for movement therepast; and i. repeating step "h" as many times as necessary until the well tool reaches the desired depth in the well.

25. A method of claim 24 wherein the steps of actuating and releasing of the tool stopping devices are repeated to cause the well tools to stop at known checkpoints while being moved both into and out of the well tubing string.

26. The method of claim 24, or 25 wherein said well tools are moved into and out of the well by pressurized fluid as in pumpdown operations and arrival of the tools at each checkpoint is noted by a resultant increase in pump pressure.

27. The method of claim 39 wherein all of the tool stopping devices are supplied pressurized control fluid through a common control fluid conduit and actuate in unison and wherein the steps of actuating and releasing the tool stopping devices by application and release of control pressure are repeated to cause said tool train to be stopped at successive checkpoints in said string of well tubing while said tool train is both being moved into and out of said well tubing.

28. A method of determining the location of a tool train in a well having plural strings of well tubing during pumpdown operations in said well by means indicating the arrival of said tool train at one or more checkpoints at known locations in one of said well tubing strings, comprising the steps of:

a. providing a well bore;

b. assembling well flow conduit means, said well flow conduit means including plural strings of well tubing, at least two of said strings of well tubing having at least one fluid pressure actuated releasable tool stopping device, each such device being at a known location and constituting a checkpoint, each such tool stopping device having plural tool stopping lugs therein movable between inner tool stopping and outer tool releasing positions and being actuatable from the earth's surface;

c. installing said well flow conduit means in said well;

d. establishing a flow course in said well for circulation of fluids therethrough for pumping well tools into and out of one of said at least two strings of well tubing;

e. providing a source of pressurized control fluid at the earth's surface;

f. providing a flow path between said tool stopping device and said source of pressurized control fluid for conducting control fluid to said device from the surface for actuation thereof;

g. moving a well tool into a selected one of said at least two strings of well tubing;

h. actuating said at least one tool stopping device in said selected string of well tubing by applying control pressure thereto to stop said tool train at the first one of said at least one tool stopping device;

i. observing the increase in pump pressure resulting from the stoppage of said tool train at such device and noting the location of said tool train at such checkpoint in said selected string of well tubing;

j. releasing control fluid pressure from the tool stopping device at which said tool train is stopped to release said tool train;

k. allowing said tool train to pass through said tool stopping device;

l. actuating the next tool stopping device in said selected string of well tubing to stop said tool train thereat; and m. observing the increase in pump pressure resulting from the stoppage of said tool train at such device and noting the location of said tool train in said selected string of well tubing.

29. The method of claim 28 wherein all of the tool stopping devices are supplied pressurized control fluid through a common control fluid conduit for simultaneous actuation thereof and wherein the steps of actuating and releasing the tool stopping devices by application and release of control pressure are repeated to cause said tool train to be stopped at successive known checkpoints in the well.

30. The method of claim 28 wherein all of the tool stopping devices are supplied pressurized control fluid through a common control fluid conduit and actuate in unison and wherein the steps of actuating and releasing the tool stopping devices by application and release of control pressure are repeated to cause said tool train to be stopped at successive checkpoints in selected string of well tubing while said tool train is both being moved into and out of said well tubing.

31. A device for stopping a well tool moving through a well flow conductor and carrying an orienting key, said device comprising:

a. a tubular body connectable in said well flow conduit in coaxial relation therewith and having a lateral window intermediate its ends;

b. an orienting sleeve in said body and surrounding its bore, said orienting sleeve having a longitudinal slot extending therethrough and a guide surface below the slot and directed upwardly toward the lower end of said slot, said orienting sleeve having its orienting slot communicating with said lateral window intermediate its ends;

c. a lug carried in said lateral window and movable radially between an inner position in which an inward portion thereof projects into and substantially blocks said orienting slot of said orienting sleeve and an outer, retracted position wherein it does not project into or obstruct said slot;

d. means carried on said body for positively moving said lug between its inner and outer positions, said moving means including:

i. fluid pressure actuated means engageable with said lug for moving said lug from its outer to its inner position to block said orienting slot, and ii. means biasing said lug towards retracted position to clear said orienting slot.

32. A device attachable to a side pocket mandrel for orienting a kickover tool therein with respect to the offset receptacle in the side pocket mandrel, said device comprising:

a. a tubular body connectable to a tubing string and to a side pocket mandrel in coaxial relation therewith and having a lateral window intermediate its ends;

b. an orienting sleeve in said body and having an orienting slot extending longitudinally through said sleeve, said slot being aligned with said window in said body and extending both thereabove and therebelow, said orienting sleeve having a guide surface below said slot and extending upwardly towards the lower end of said slot;

c. a lug carried in said lateral window of said body and movable radially between an inner position in which it extends into and blocks said orienting slot for stopping a kickover tool whose orienting key has been guided thereinto and an outer position wherein said lug does not project into or obstruct said orienting slot;

d. means carried on said body for positively moving said lug between its inner and outer positions, said moving means including:

i. annular piston means slidably mounted about said body and said lug, said piston means and said lug having coengageable means for positively moving said lug between inner and outer positions responsive to longitudinal relative movement of said piston on said body, ii. a housing surrounding said body and spaced therefrom and forming an annulus therebetween housing said piston, said housing having a lateral port near its upper end, iii. means on said body closing the opposite ends of said annulus, iv. biasing means in said annulus biasing said piston towards its upper position to hold said lug in retracted position, and v. means sealing between said body and said piston and between said piston and said housing defining a pressure responsive area on said piston exposed to fluid pressure transmitted into said annulus through said housing lateral port for moving said piston to its lower position to move said lug to its inner position to block said orienting slot.

33. The device of claim 32 wherein said coengageable means on said piston and lug comprise:

a. head means on the outer end of said lug providing a pair of inclined cam surfaces; and b. a window in the wall of said piston providing a pair of inclined cam surfaces, said cam surfaces on said piston being engageable with said cam surfaces on said lug to cam said lug inward upon downward movement of said piston and to cam said lug outward upon upward movement of said piston.

34. The device of claim 33 wherein said biasing means is a coil spring supported in said annulus and having its upper end applying an upward force to said piston tending to move it upwardly, and wherein said lateral port of said housing is connectable to a control fluid conduit for supplying pressurized control fluid to the device for actuation thereof remotely from the surface.

35. A side pocket mandrel comprising:

a. an elongate body with an open bore therethrough and having means on its opposite ends for attachment to a well flow conductor;

b. a belly in said body offset from said main bore providing space for operation of a kickover tool;

c. a receptacle bore offset from and extending alongside said main bore and having one of its ends opening into said belly, said receptacle bore being adapted to receive a flow control device in locking and sealing relation therewith;

d. fluid passage means in the wall of said receptacle bore communicating the exterior of said body with the interior thereof;

e. orienting means in said body adjacent said belly for orienting a kickover tool with respect to said receptacle bore, said orienting means including:

1. an orienting sleeve surrounding said bore, 2. an orienting slot extending longitudinally through said orienting sleeve, 3. a guide surface below said slot and directed upwardly toward the lower end of said slot, and 4. a lug projecting into said slot to block said slot intermediate its ends, said lug being retractable to a position opening said slot; and f. remotely actuable means for moving said lug between slot blocking and retracted positions.

36. The side pocket mandrel of claim 35 wherein said lug is disposed in a lateral window in said body for radial movement therein and has its outer end projecting into said annulus, and said remotely actuable means includes:

a. a housing surrounding a portion of said body and spaced therefrom forming an annulus therebetween, said housing having a port near one of its ends;

b. means on said body closing the opposite ends of said annulus; and c. piston means slidable longitudinally in said annulus and having cam means thereon for engaging the outer end of said lug and moving said lug between inner and outer positions, said piston being movable longitudinally relative to said body in response to pressurized control fluid transmitted into said annulus through said lateral port.

37. A side pocket mandrel comprising:

a. an elongate body with an open bore therethrough and having means on its opposite ends for attachment to a well flow conductor;

b. a belly in said body offset from said main bore providing space for operation of a kickover tool;

c. a receptacle bore offset from and extending alongside said main bore and having one of its ends opening into said belly, said receptacle bore being adapted to receive a flow control device in locking and sealing relation therewith;

d. fluid passage means in the wall of said receptacle bore communicating the exterior of said body with the interior thereof;

e. orienting means in said body adjacent said belly for orienting a kickover tool with respect to said receptacle bore, said orienting means including:

1. an orienting sleeve surrounding said bore, 2. an orienting slot extending longitudinally through said orienting sleeve, 3. a guide surface below said slot and directed upwardly toward the lower end of said slot, and 4. a lug projecting into said slot to block said slot intermediate its ends, said lug being retractable to a position opening said slot; and f. remotely actuable means for moving said lug between slot blocking and slot opening position, said moving means including:

1. cam block means mounted for limited longitudinal movement in an eccentric cavity in said body and having cam means thereon engageable with said lug for moving said lug between slot blocking and slot opening positions responsive to relative longitudinal movement of said cam block means in said cavity of said body, 2. eccentric piston means in said body having a portion thereof engaging said cam block means and having a pressure responsive area exposable to fluid pressure transmitted thereto from the surface for moving the cam block means in a first longitudinal direction, and 3. biasing means carried by said body and engaged with said cam block means for moving said cam block means in a second longitudinal direction opposite said first longitudinal direction.

38. The device of claim 37 wherein said side pocket mandrel including said remotely actuable means is formed with a cross section of substantially oval shape.

39. A well system for orienting and stopping well tools in a well flow conductor, comprising:

a. a well bore;

b. a well flow conductor in said well bore; and c. at least one tool stopping device connected in said well flow conductor and forming a part thereof, each said at least one tool stopping device having i. an orienting sleeve therein surrounding its bore, said orienting sleeve having an orienting slot extending longitudinally therethrough and a guide surface below the orienting slot and directed upwardly to the lower end of the orienting slot, ii. A lug mounted in a lateral window of the device for radial movement between an inner position in which it blocks the orienting slot of the orienting sleeve for stopping a well tool moving therethrough and an outer position wherein it does not block the slot.

40. The system of claim 39 wherein at least one of said at least one tool stopping devices includes a side pocket mandrel and said orienting sleeve and said lug are operable to orient and stop a kickover tool therein.

* * * * *